US006244330B1

(12) United States Patent
Eisinger et al.

(10) Patent No.: US 6,244,330 B1
(45) Date of Patent: Jun. 12, 2001

(54) ANTI-VIBRATION TIES FOR TUBE BUNDLES AND RELATED METHOD

(75) Inventors: Frantisek L. Eisinger, Demarest; Madhava M. Rao, Morris Plains, both of NJ (US)

(73) Assignee: Foster Wheeler Corporation, Clinton, NJ (US)

( * ) Notice: Subject to any disclaimer, the term of this patent is extended or adjusted under 35 U.S.C. 154(b) by 0 days.

(21) Appl. No.: 09/192,192

(22) Filed: Nov. 16, 1998

(51) Int. Cl.[7] ..... F28D 7/08

(52) U.S. Cl. ..... 165/69; 165/82; 165/162; 122/510

(58) Field of Search ..... 165/69, 162, 82; 122/510

(56) References Cited

U.S. PATENT DOCUMENTS

| | | | | |
|---|---|---|---|---|
| 2,126,687 | * | 8/1938 | Martin | 165/162 X |
| 2,927,781 | | 3/1960 | Fohrhaltz et al. . | |
| 3,199,582 | | 8/1965 | Vogt et al. . | |
| 3,643,735 | | 2/1972 | Huggins . | |
| 3,708,142 | | 1/1973 | Small . | |
| 3,896,771 | | 7/1975 | Chayes et al. | 122/510 |
| 3,896,874 | | 7/1975 | Bongaards et al. . | |
| 3,929,189 | | 12/1975 | Lecon . | |
| 4,013,024 | * | 3/1977 | Kochey, Jr. et al. | 165/162 X |
| 4,337,827 | * | 7/1982 | Jabsen | 165/162 X |
| 4,480,594 | * | 11/1984 | Sullivan et al. | 122/510 |
| 4,550,777 | | 11/1985 | Fournier et al. . | |
| 4,662,434 | | 5/1987 | Porowski . | |
| 4,720,840 | * | 1/1988 | Lagally et al. | 165/69 X |
| 4,981,169 | | 1/1991 | Eisinger . | |
| 5,012,767 | * | 5/1991 | Sheikh et al. | 165/162 X |
| 5,033,542 | * | 7/1991 | Jabs | 165/162 |
| 5,050,669 | * | 9/1991 | Nenstiel et al. | 165/162 |
| 5,127,469 | | 7/1992 | Boula . | |
| 5,136,985 | | 8/1992 | Krowech . | |
| 5,213,155 | | 5/1993 | Hahn | 165/162 |
| 5,711,350 | | 1/1998 | Eisinger . | |

FOREIGN PATENT DOCUMENTS

| | | | | |
|---|---|---|---|---|
| 219263 | | 6/1942 | (CH) . | |
| 248996 | * | 10/1987 | (JP) | 165/162 |

OTHER PUBLICATIONS

Chen, S.S., "Instability Mechanisms and Stability Criteria of Group of Circular Cylinders Subjected to Cross–Flow, Part 1: Theory," *ASME Journ. of Vibration Acoustics, Stress and Reliability in Design*, vol. 105, pp. 51–58, Jan. 1983.

(List continued on next page.)

*Primary Examiner*—Leonard Leo
(74) *Attorney, Agent, or Firm*—Fitzpatrick, Cella, Harper & Scinto

(57) ABSTRACT

A method of reducing vibration in a bank of tubes due to fluid crossflow, the tubes having substantially parallel longitudinal axes. The method includes the steps of selecting a plurality of tubes from the bank of tubes and interconnecting the selected tubes so as to restrain motion of the selected tubes relative to one another in at least one direction, transverse to the longitudinal axes of the tubes, while permitting each of the selected tubes to rotate on its longitudinal axis and expand and contract in a region adjacent to the interconnection. Also disclosed are various apparatus for reducing vibration in a bank of tubes due to fluid crossflow.

27 Claims, 24 Drawing Sheets

ARRANGEMENT OF ANTI-VIBRATION TIES WITHIN TUBE BANKS

ALL PLATE TO BE A-240-304H
OR ALL PLATE TO BE A-387-11

H-CLIP DETAILS FOR 2 LOOP-IN LOOP TUBE BANKS

OTHER PUBLICATIONS

Chen, S.S., "Instability Mechanisms and Stability Criteria of Group of Circular Cylinders Subjected to Cross–Flow, Part 2: Numerical Results and Discussions," *ASME Journ. of Vibration Acoustics, Stress and Reliability in Design*, vol. 105, pp. 253–260, Apr. 1983.

Chen, S.S., et al., "Fluidelastic Instabilities in Tube Bundles Exposed to Nonuniform Crossflow," *Argonne National Laboratory*, ANL–98/13, Jun. 1989.

Eisinger, F.L., et al., "Effect of Tube–to–Tube Ties on Fluidelastic Instability of Tube Arrays Exposed to Crossflow," *Journ. of Pressure Vessel Tech., ASME*, vol. 120, pp. 179–185, May 1998.

Eisinger, F.L., et al., "Effect of Tube–to–Tube Ties on Fluidelastic Instability of Normal Triangular Tube Arrays Exposed to Crossflow," *ASME, PVP–vol. 363, Flow–Induced Vibration and Transient Thermal–Hydraulics*, Book No. H01144–1998, pp. 45–51 (1998).

Eisinger, F.L., et al., "Effect of Tube–to–Tube Ties on Fluidelastic Instability of Tube Arrays Exposed to Crossflow," 4$^{th}$ *International Symposium on Fluid–Structure Interactions, Aeroelasticity, Flow–Induced Vibration and Noise*, vol. 2, AD vol. 53–2, ASME, pp. 221–228 (Nov. 16, 1997).

* cited by examiner

ARRANGEMENT OF ANTI-VIBRATION TIES WITHIN TUBE BANKS

ARRANGEMENT OF A MULTISPAN FOSSIL-FIRED STEAM GENERATOR TUBE BANK

H-CLIP ARRANGEMENT WITHIN 2 LOOP-IN-LOOP AND 3 LOOP-IN-LOOP TUBE BANKS

ALL PLATE TO BE A-588-GR-A OR B

ALL PLATE TO BE A-240-304H
OR ALL PLATE TO BE A-387-11

H-CLIP DETAILS FOR 2 LOOP-IN LOOP TUBE BANKS

H-CLIP ARRANGEMENT WITHIN 4 LOOP-IN-LOOP AND 5 LOOP-IN-LOOP TUBE BANKS

ALL PLATE TO BE A-240-304H
H-CLIP DETAILS FOR 4 LOOP-IN-LOOP TUBE BANK

ALL PLATE TO BE A-240-304H
OR ALL PLATE TO BE A-387 11
OR ALL PLATE TO BE A -588 GR A OR B

H-CLIP DETAILS FOR 5 LOOP-IN-LOOP TUBE BANK

NOTES ON H-CLIP INSTALLATION PROCEDURE
(1) SPREAD TUBES
(2) INSERT H-CLIP
(3) ROTATE INTO POSITION
(4) SECURE POSITION OF H-CLIP WITH STUDS
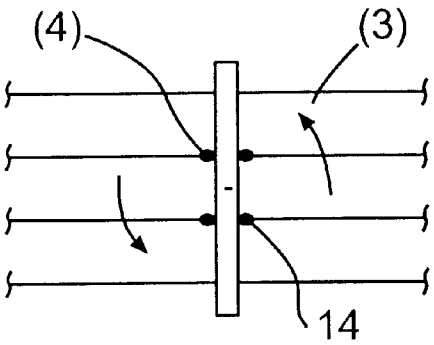
STEPS 3,4
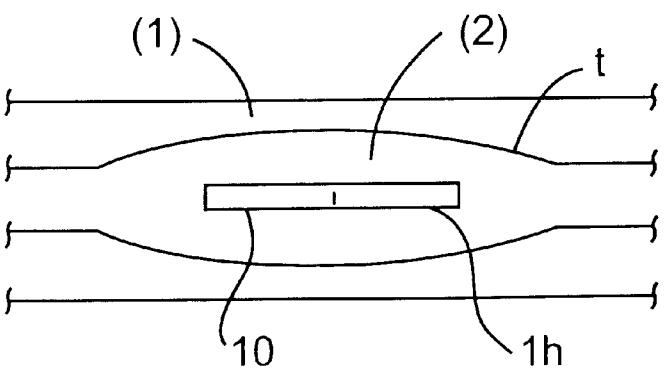
STEPS 1,2
FIG. 5A

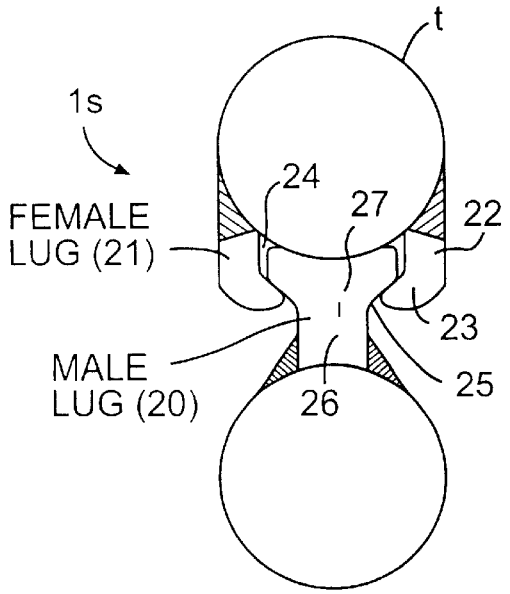
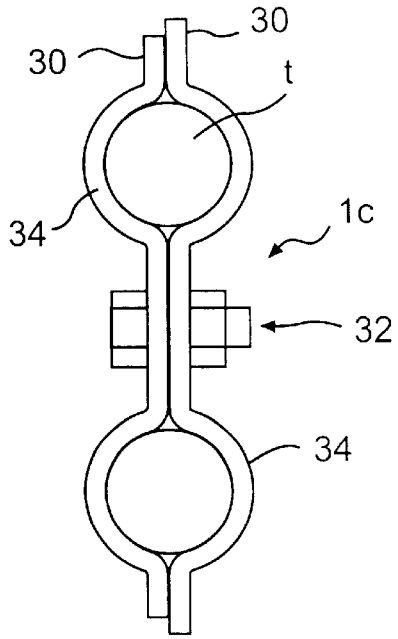
STRUCTURAL CONFIGURATIONS OF TUBE-TO-TUBE TIES:
FIG. 6A) SLIP SPACER, FIG. 6B) CLAMP
*FIG. 6A* *FIG. 6B*

TWO LOOP-IN-LOOP

THREE LOOP-IN-LOOP

FOUR LOOP-IN-LOOP

FLUIDELASTIC STABILITY MAP FOR A SINGLE TUBE ROW WITH P/D = 1.33. SHOWN ARE STABILITY LIMITS FOR A FULLY FLEXIBLE ROW AND FOR GROUPS OF 2 TUBES TIED TO EACH OTHER

FLUIDELASTIC STABILITY MAP FOR A SINGLE TUBE ROW WITH P/D = 1.33. SHOWN ARE STABILITY LIMITS FOR A FULLY FLEXIBLE ROW AND FOR GROUPS OF 3 TUBES TIED TO EACH OTHER

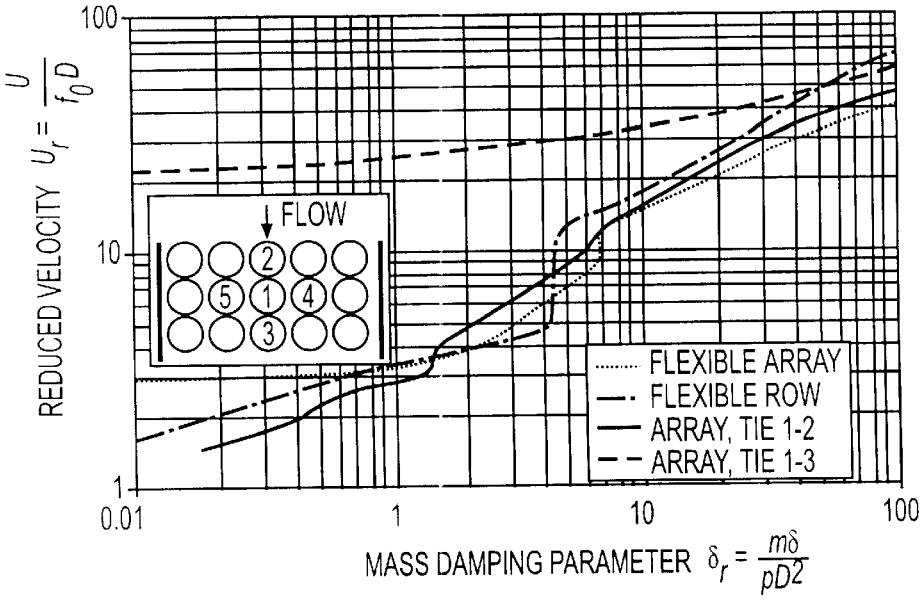

FLUIDELASTIC STABILITY MAP FOR AN IN -LINE SQUARE TUBE ARRAY WITH P/D = 1.33. SHOWN ARE STABILITY LIMITS FOR TWO ARRANGEMENTS OF GROUPS OF 2 TUBES TIED TO EACH OTHER IN THE FLOW DIRECTION. STABILITY LIMITS FOR FULLY FLEXIBLE TUBE ARRAYS ARE SUPERIMPOSED

FIG. 8C

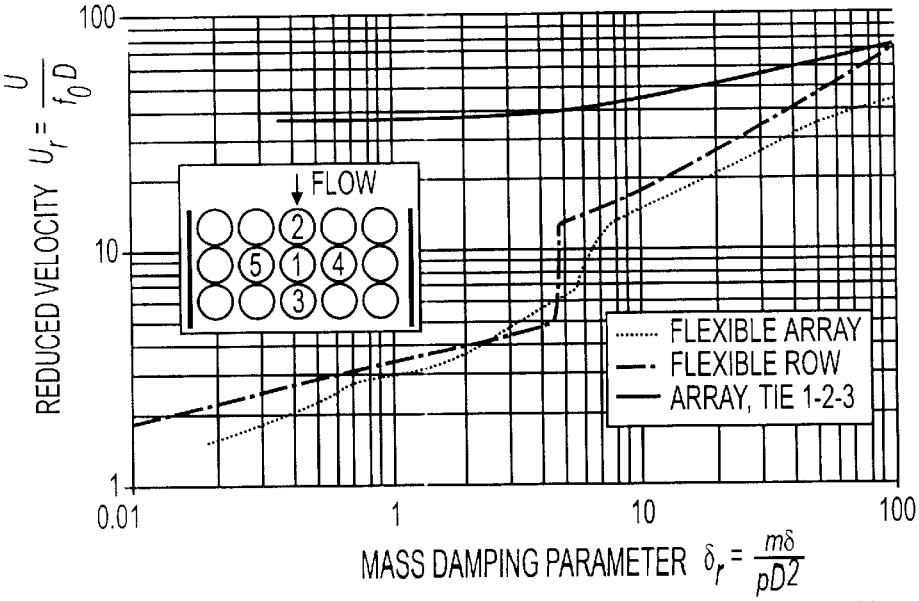

FLUIDELASTIC STABILITY MAP FOR AN IN -LINE SQUARE TUBE ARRAY WITH P/D = 1.33. SHOWN ARE STABILITY LIMITS FOR THE ARRANGEMENT OF GROUPS OF 3 TUBES TIED TO EACH OTHER IN THE FLOW DIRECTION. LIMITS FOR FULLY FLEXIBLE TUBE ARRAYS ARE SUPERIMPOSED

FIG. 8D

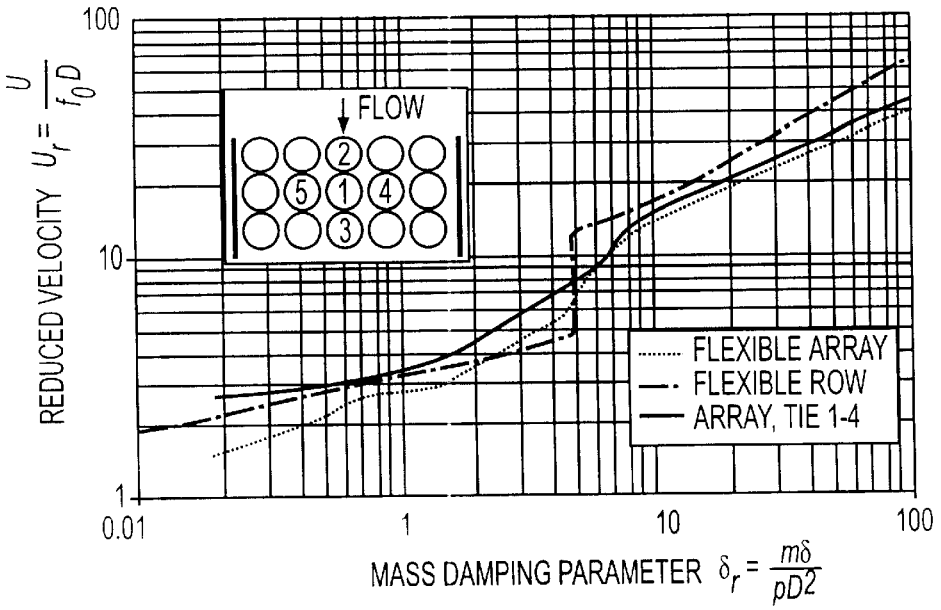

FLUIDELASTIC STABILITY MAP FOR AN IN -LINE SQUARE TUBE ARRAY WITH P/D = 1.33. SHOWN ARE STABILITY LIMITS FOR GROUPS OF 2 TUBES TIED TO EACH OTHER IN THE TRANSVERSE (LIFT) DIRECTION. LIMITS FOR FULLY FLEXIBLE TUBE ARRAYS ARE SUPERIMPOSED

FIG. 8E

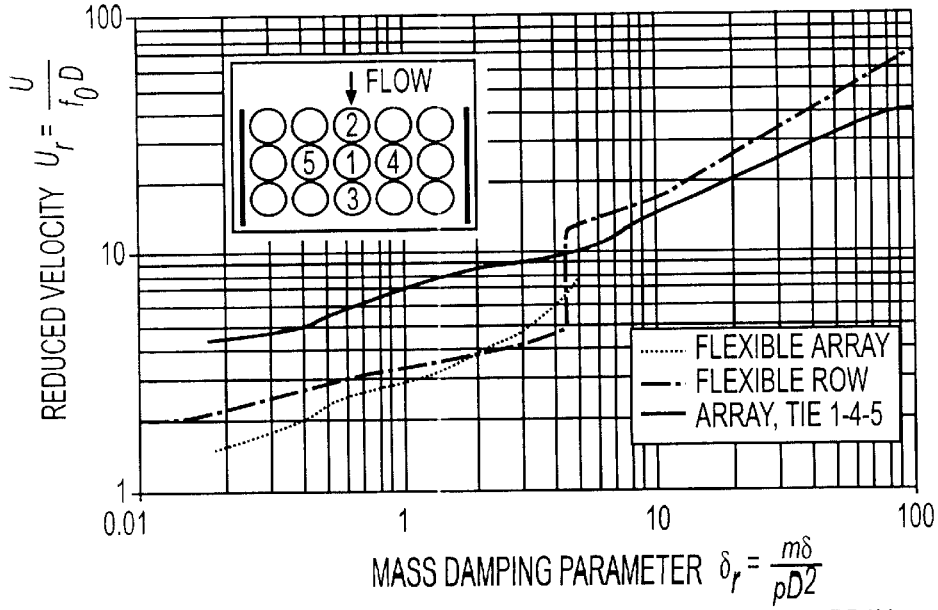

FLUIDELASTIC STABILITY MAP FOR AN IN -LINE SQUARE TUBE ARRAY WITH P/D = 1.33. SHOWN ARE STABILITY LIMITS FOR GROUPS OF 3 TUBES TIED TO EACH OTHER IN THE TRANSVERSE DIRECTION. STABILITY LIMITS FOR A FULLY FLEXIBLE TUBE ARRAY ARE SUPERIMPOSED

FIG. 8F

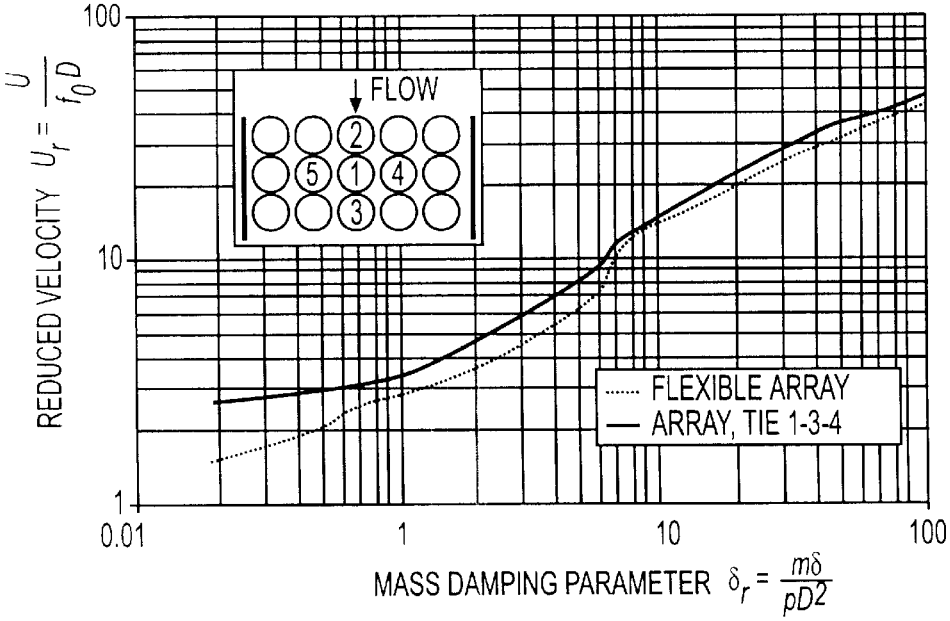

FLUIDELASTIC STABILITY MAP FOR AN IN -LINE SQUARE TUBE ARRAY WITH P/D = 1.33. SHOWN ARE STABILITY LIMITS FOR GROUPS OF 3 TUBES TIED TO EACH OTHER IN THE FLOW AND TRANSVERSE DIRECTIONS. STABILITY LIMITS FOR A FULLY FLEXIBLE ARRAY ARE SUPERIMPOSED

FIG. 8G

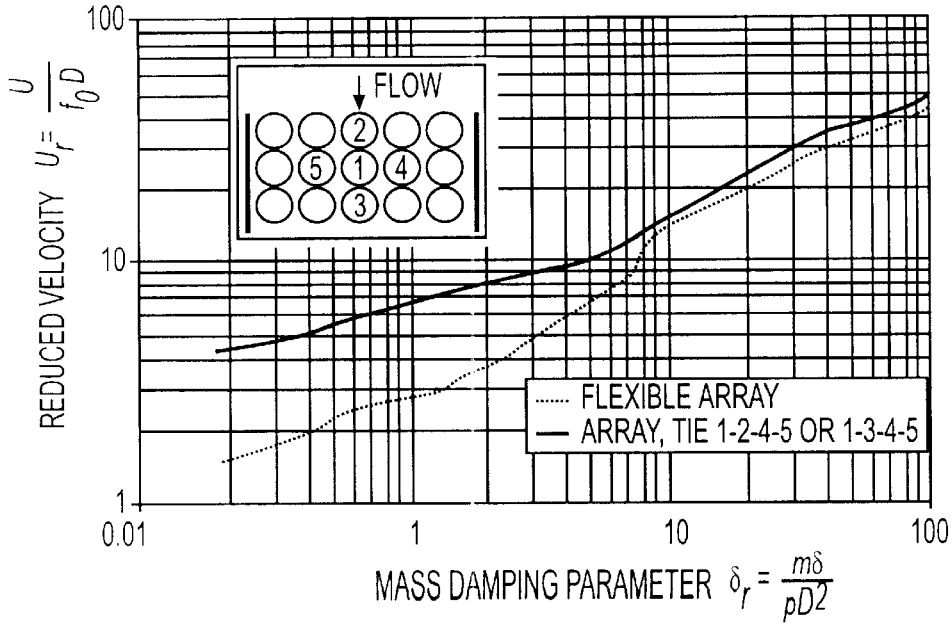

FLUIDELASTIC STABILITY MAP FOR AN IN -LINE SQUARE TUBE ARRAY WITH P/D = 1.33. SHOWN ARE STABILITY LIMITS FOR GROUPS OF 4 TUBES TIED TO EACH OTHER IN THE FLOW AND TRANSVERSE DIRECTIONS. STABILITY LIMITS FOR A FULLY FLEXIBLE ARRAY ARE SUPERIMPOSED

FIG. 8H

FLUIDELASTIC STABILITY MAP FOR AN IN -LINE SQUARE TUBE ARRAY WITH P/D = 1.33. SHOWN ARE STABILITY LIMITS FOR GROUPS OF 5 TUBES TIED TO EACH OTHER IN THE FLOW AND TRANSVERSE DIRECTIONS. STABILITY LIMITS FOR A FULLY FLEXIBLE ARRAY ARE SUPERIMPOSED

NORMAL TRIANGULAR TUBE ARRAY EXPOSED TO CROSSFLOW. SHOWN ARE DESIGNATIONS FOR FLEXIBLE TUBES IN THE UPSTREAM, MIDDLE AND DOWNSTREAM SECTIONS OF AN OTHERWISE RIGID ARRAY

CASES OF INSTABILITY WITH TUBE-TO-TUBE TIES IN PLACE

| LOCATION | TUBE-TO-TUBE TIES | INSTABILITY | |
|---|---|---|---|
| | | LIFT DIRECTION | DRAG DIRECTION |
| UPSTREAM | [1-2] | YES | NO |
| | [1-3] | YES | NO |
| | [1-4] | YES | YES |
| | [1-5] | YES | YES |
| | [1-2-3] FIG. 9B | YES | NO |
| | [2-4] | YES | NO |
| | [3-5] | YES | YES |
| | [1-2][4-5] - FIG. 9C | YES | NO |
| | [1-3][4-5] | YES | NO |
| | [1-5][2-4] | YES | NO |
| | [1-4][3-5] - FIG. 9D | YES | YES |
| MIDDLE | [1-2] | YES | NO |
| | [1-3] - FIG. 9E | YES | NO |
| | [1-4] | YES | YES |
| | [1-5] | YES | YES |
| | [1-6] | YES | YES |
| | [1-7] | YES | YES |
| | [2-4] | YES | NO |
| | [2-6] -FIG. 9H | YES | YES |
| | [3-5] | YES | NO |
| | [3-7] | YES | YES |
| | [4-5] | YES | YES |
| | [4-6] | YES | YES |
| | [5-7] | YES | YES |
| | [1-2-3] - FIG. 9F | YES | NO |
| | [1-5-6] | YES | YES |
| | [1-4-7] | YES | YES |
| | [1-2][4-5][6-7] | YES | NO |
| | [1-3][4-5][6-7] - FIG. 9G | YES | NO |
| | [1-2-3][4-5][6-7] | NO | NO |
| | [1-5][2-4][3-7] | YES | NO |
| | [1-7][2-6][3-5] | YES | NO |
| | [1-4-7][2-6][3-5] | YES | NO |
| | [4-6][5-7] | YES | YES |
| DOWNSTREAM | [1-2] | YES | YES |
| | [1-3] | YES | YES |
| | [1-4] | NO | YES |
| | [1-5] | YES | YES |
| | [1-2-3] | YES | NO |
| | [2-4] | NO | YES |
| | [3-5] | YES | YES |
| | [4-5] | YES | YES |
| | [1-2-3][4-5] - FIG. 9I | YES | NO |
| | [1-2][4-5] | YES | YES |
| | [1-3][4-5] - FIG. 9J | YES | YES |
| | [1-5][2-4] | NO | YES |
| | [1-4][3-5] | NO | YES |

FIG. 10

EFFECT OF POSITION OF TUBE-TO-TUBE TIE ON FUNDAMENTAL MODE FREQUENCY (IN-PLANE OR OUT-OF-PLANE) OF 2 TUBES TIED TO EACH OTHER

EFFECT OF POSITION OF TUBE-TO-TUBE TIE ON FUNDAMENTAL MODE FREQUENCY (IN-PLANE OR OUT-OF-PLANE) OF 3 TUBES TIED TO EACH OTHER

ANTI-VIBRATION TIES FOR TUBE BUNDLES AND RELATED METHOD

FIELD OF THE INVENTION

The present invention relates to tube banks subjected to fluid crossflow in heat exchangers, steam generators, and similar environments. More particularly, the present invention relates to an apparatus and method for tying together two or more of the individual tubes in such a bank in order to lessen the incidence and impact of flow-induced vibrations.

BACKGROUND OF THE INVENTION

Banks of fluid-carrying tubes often experience flow-induced vibrations when subjected to external fluid crossflow in tube-in-shell heat exchangers, nuclear fuel bundles, steam generators and the like. The excitation mechanisms typically involved are vortex shedding, turbulence and fluidelastic instability. The first two vibrations are generally present throughout the anticipated load range, but the tube structure is typically designed to be capable of withstanding their long-term effects. However, fluidelastic type vibration is characterized by large amplitude displacements and often has a structurally damaging effect. A heat exchanger must, therefore, be designed to eliminate or minimize the damaging effects of fluidelastic vibration.

To reduce the impact of fluidelastic instability within the operating flow range, it is preferable to design the tube bank so that the critical crossflow fluidelastic velocities are sufficiently greater than the maximum design crossflow velocity. A minimum safety factor of 1.5, representing the ratio between the critical and the maximum crossflow velocities, is typically sought to assure the absence of fluidelastic vibration. In order to obtain the necessary critical velocities, sufficiently high tube natural frequencies are needed. The required tube frequencies are typically achieved by shortening tube spans between adjacent supports or tube support plates and/or by providing reasonably close tolerances in tube-to-support clearances.

In the cases of flexible tube banks or banks exposed to high flow velocities, a large number of supports or support plates may be needed in order to maintain the desired ratio between the critical and actual flow velocities. This can increase costs, increase pressure drops, complicate erosion/corrosion considerations, complicate overall design, and undermine performance. Thus, it is desirable to utilize simpler designs with a minimum of main supports. This reduction in the number of supports may require the addition of tube-to-tube ties to achieve the required vibration resistance of the tube bank.

Many attempts have been made to address these vibration concerns by means of tube-to-tube ties. For example, U.S. Pat. No. 5,213,155, to Hahn, attempts to dampen vibrations resulting from temperature changes and fluid flow through and outside the tubes. The tubes 15, 19, 23 are clamped via metal tie fasteners 30, 40 between parallel strips 2, 3 of a U-shaped stake. Each strip portion 2, 3 has a "soft V" cross section and a plurality of longitudinally-spaced "saddles" 14, 16, 18, 20, 22, 24 that engage the tubes.

Another example, U.S. Pat. No. 5,136,985, to Krowech, is an attempt to increase mechanical stability and decrease vibrations due to gas flow around tubes in a heat exchanger. A plurality of the tubes 16 are interconnected by a support 20. A tie bar 30, with a plurality of spaced apart fingers 32, is positioned so that one boiler tube 16 fits between each pair of adjacent fingers 32. A locking bar 44 is wedged between the row of tubes 16 and a series of retainer pins 40 of the tie bar, clamping the tie bar to the tubes. The locking bar is then welded to either the tie bar or one of the tubes.

U.S. Pat. No. 3,708,142, to Small, shows that in order to suppress vibration of tubes 2 arranged in rows and columns in, for example, a tube-in-shell heat exchanger, the tubes are held together in three-dimensional bundles. Support rods 16, 26 extend across the rows and columns, respectively, of tubes, with one rod positioned between each tube row or column. Each successive rod is laterally spaced a common distance along the length of the tubes. Securing means 36, 38, such as metal bands, are attached to the ends of each rod to maintain and urge the rods together to form a unitary tube bundle.

U.S. Pat. No. 4,550,777, to Fournier, et al., shows an attempt to reduce stresses from weight distribution, vibrations, and thermal expansion in tubes in a heat exchanger, in which the tubes are suspended vertically in a serpentine arrangement from inlet and outlet ends. Lengths of the tube are interlocked to transfer the weight of the middle tubes to the outer tubes depending from the inlet and outlet. Complementary interlocking members 12, 13 are welded to adjacent tubes and interlocked as shown in FIG. 2. A stop 22 is welded to one of the tubes to prevent the interlocking members from disengaging.

U.S. Pat. No. 3,929,189, to Lecon, shows another attempt to reduce the vibration of tubes in a heat exchanger. A structural framework is formed of a plurality of flat bars 66 interconnected at their respective upper and lower ends by tie bars 68. Adjacent bars 66 are drawn tightly against a row of the tubes and interconnected by second retaining members 72. The framework preserves the spacing between the tubes and prevents direct contact between the tubes.

While the known designs may help to control the inter-tube motion in the tube banks, most do so by tightly locking the tubes in a bundle. Thus, these approaches do not provide for maintaining a reasonably flexible tube bundle. These limitations can produce undesirable restrictions on the thermal expansion of the individual tubes. They can also create a rigid multiple-tube structure that has additional, inherent vibration concerns itself.

SUMMARY OF THE INVENTION

The present invention addresses the foregoing needs in the art by providing tube-to-tube ties that permit a degree of relative rotation, expansion, and transverse motion of the tubes in the region adjacent to the ties.

The present invention relates, in one aspect, to a method of reducing vibration in a bank of tubes due to fluid crossflow. Based on the particular tube bank and flow characteristics, a plurality of tubes (generally, two to six) is selected from the bank of tubes and interconnected. The tubes are interconnected so as to restrain motion of the selected tubes relative to one another in at least one direction, transverse' to the longitudinal axes of the tubes, while permitting each of the selected tubes to rotate on its longitudinal axis and expand and contract in a region adjacent to the interconnection.

Preferably, the interconnection is accomplished without providing any additional connection to an external support. In many cases, the interconnection should be located approximately mid-span between adjacent external supports.

As will be seen, often it will be preferable to select tubes that are aligned, i.e., all intersect a common imaginary line. In most cases, it will be preferable to select tubes that are aligned approximately parallel to the crossflow. The interconnection will generally restrain motion of the selected tubes at least in a direction that is approximately perpendicular to the line of tubes.

In another aspect, the present invention relates to an apparatus for reducing vibration in a bank of tubes due to fluid crossflow, where the tubes have substantially parallel longitudinal axes. The apparatus includes a tube-to-tube tie, interconnecting a plurality of the tubes, and a motion limiter. The tie includes complementary lateral restraints cooperating to restrain lateral motion of the plurality of tubes relative to one another, wherein the tie permits each of the plurality of tubes a degree of freedom to rotate on its longitudinal axis and expand and contract in a region adjacent to the tie. The motion limiter is affixed to at least two of the plurality of tubes so as to limit longitudinal motion of the tie relative to the plurality of tubes.

Where each of the plurality of tubes has a substantially equal nominal outer diameter, the lateral restraints are disposed on opposite sides of the plurality of tubes and are spaced apart by a lateral distance that is greater than the nominal outer diameter of each of the plurality of tubes. The lateral distance is preferably not more than approximately two percent greater than the nominal outer diameter. A lateral spacer can be disposed between an adjacent pair of the plurality of tubes and interconnect the lateral restraints so as to maintain the lateral distance therebetween.

The lateral restraints can include a male lug affixed to one of the plurality of tubes and a complementary female lug, the female lug being affixed to an adjacent one of the plurality of tubes and having a cavity in which the male lug fits. The motion limiters can be welds holding the male and female lugs in place.

In yet another aspect, this invention relates to an apparatus for reducing vibration in a bank of tubes due to fluid crossflow, where the tubes have substantially parallel longitudinal axes. The apparatus includes a tube-to-tube tie, interconnecting a linearly aligned plurality of the tubes each having a substantially equal nominal outer diameter, and a motion limiter. The tie includes opposing restraints, disposed on opposite lateral sides of the plurality of tubes, and a spacer disposed between an adjacent pair of the plurality of tubes and extending laterally between the restraints. The restraints are substantially parallel and spaced apart by a lateral distance that is greater by no more than approximately two percent than the nominal outer diameter of each of the plurality of tubes. The motion limiter is affixed to at least two of the plurality of tubes so as to limit longitudinal motion of the tie relative to the plurality of tubes.

The restraints can be elongated, substantially rectangular side members, and the spacer can be an elongated, substantially rectangular cross-bar. The cross-bar is preferably substantially perpendicular to the side members. The lateral distance between the side members is preferably not less than approximately one percent greater than the outer diameter of the plurality of tubes.

These and other aspects, objects, features and advantages of the present invention will be better understood from the following discussion with reference to the following drawings, in which like reference characters refer to like elements throughout.

BRIEF DESCRIPTION OF THE DRAWINGS

FIG. 5A is a schematic representation of a process of installation of one of the tube-to-tube ties illustrated in FIGS. 3A–4C.

FIGS. 6A and 6B are schematic cross sections of alternate embodiments of tube-to-tube ties according to the present invention.

FIGS. 8C–8I are stability maps for various tube groupings according to embodiments of the present invention in an in-line square tube array.

FIG. 10 is a tabulation of stability analysis results for various tube grouping according to embodiments of the present invention in the array of FIG. 9A.

DETAILED DESCRIPTION OF THE PREFERRED EMBODIMENTS

Figure 1:
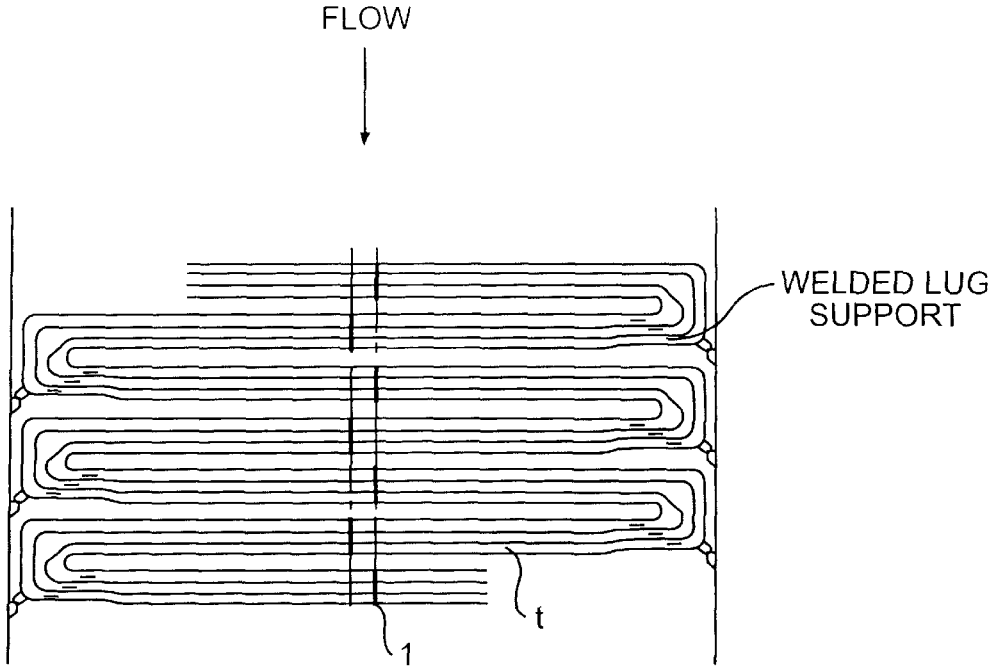
FIG. 1 is a schematic view of a single-span tube bank employing tube-to-tube ties according to an embodiment of the present invention.
Figure 2:
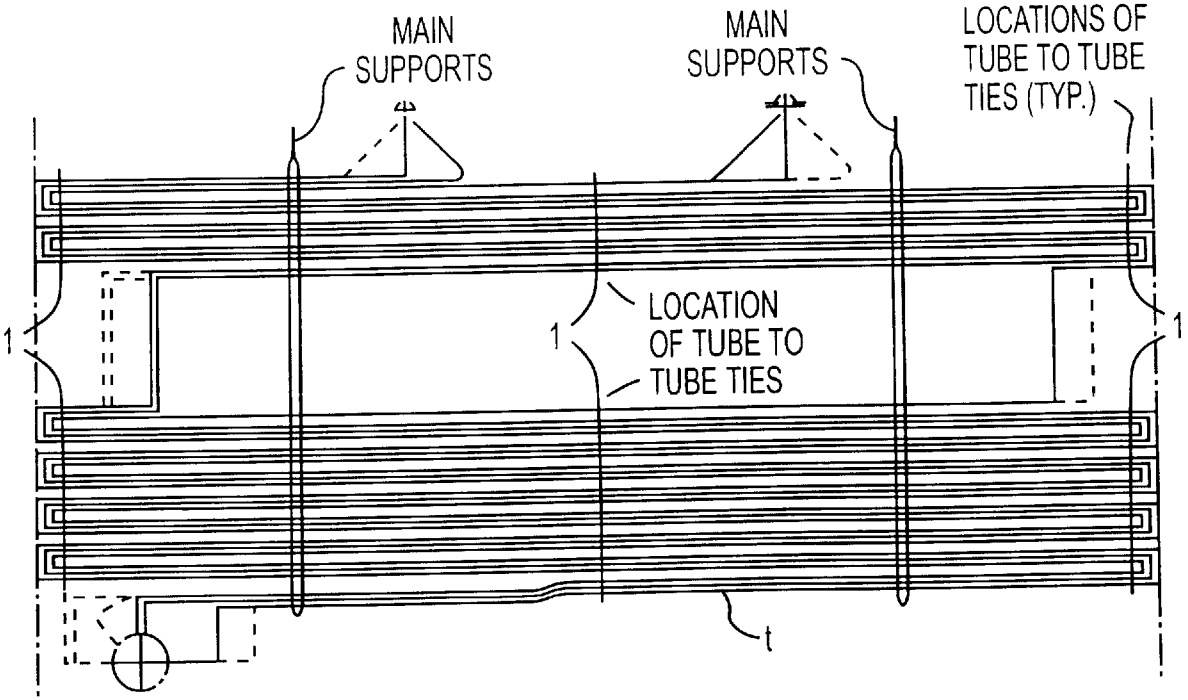
FIG. 2 is a schematic view of a multi-span tube bank employing tube-to-tube ties according to an embodiment of the present invention.

This invention relates, in one aspect, to a method of reducing vibration in a bank of tubes t due to fluid crossflow. FIGS. 1 and 2 illustrate examples of the tube-to-tube tie method of the present invention, as applied to tube bundles of fossil-fired steam generators. FIG. 1 illustrates a single-span arrangement, tube-to-tube ties 1 are utilized within the tube span. FIG. 2 shows a multispan arrangement, in which tube-to-tube ties 1 are used in the center span and also in the cantilever portions.

Based on the particular tube bank and flow characteristics, a plurality of tubes (generally two to six) is selected from the bank of tubes t and interconnected. The tubes t are interconnected in at least a first direction that is substantially perpendicular to the longitudinal axes of the tubes t. The interconnection is done so as to restrain motion of the selected tubes t relative to one another in at least a second direction (approximately perpendicularly to the first direction and the longitudinal axes of the tubes) while permitting each of the selected tubes t to rotate on its longitudinal axis and expand and contract in a region adjacent to the interconnection. Preferably, the interconnection is accomplished without providing any rigid connection to an external support.

One aspect of the structural configuration of the tube-to-tube ties 1 is that the tube-to-tube axial motion is not completely restricted. This feature is important in heat exchangers where tube-to-tube temperature differentials may occur. The ties 1 also do not restrict the relative rotation of the tubes t at the point of contact. The ties 1 do, however, act as relatively rigid restraints between the tubes t in at least one direction in the plane normal to the axes of the tubes, thus coupling the transverse motion of the restrained tubes t at the point of attachment.

The purpose of tying the tubes t together is to affect the vibratory mode shape of the tubes, in many cases with little or no change to the natural frequency of the tubes t. Changing the mode shape can substantially increase the critical velocity for fluidelastic vibration, thus reducing or eliminating fluidelastic vibration within given flow ranges.

Figure 3A:
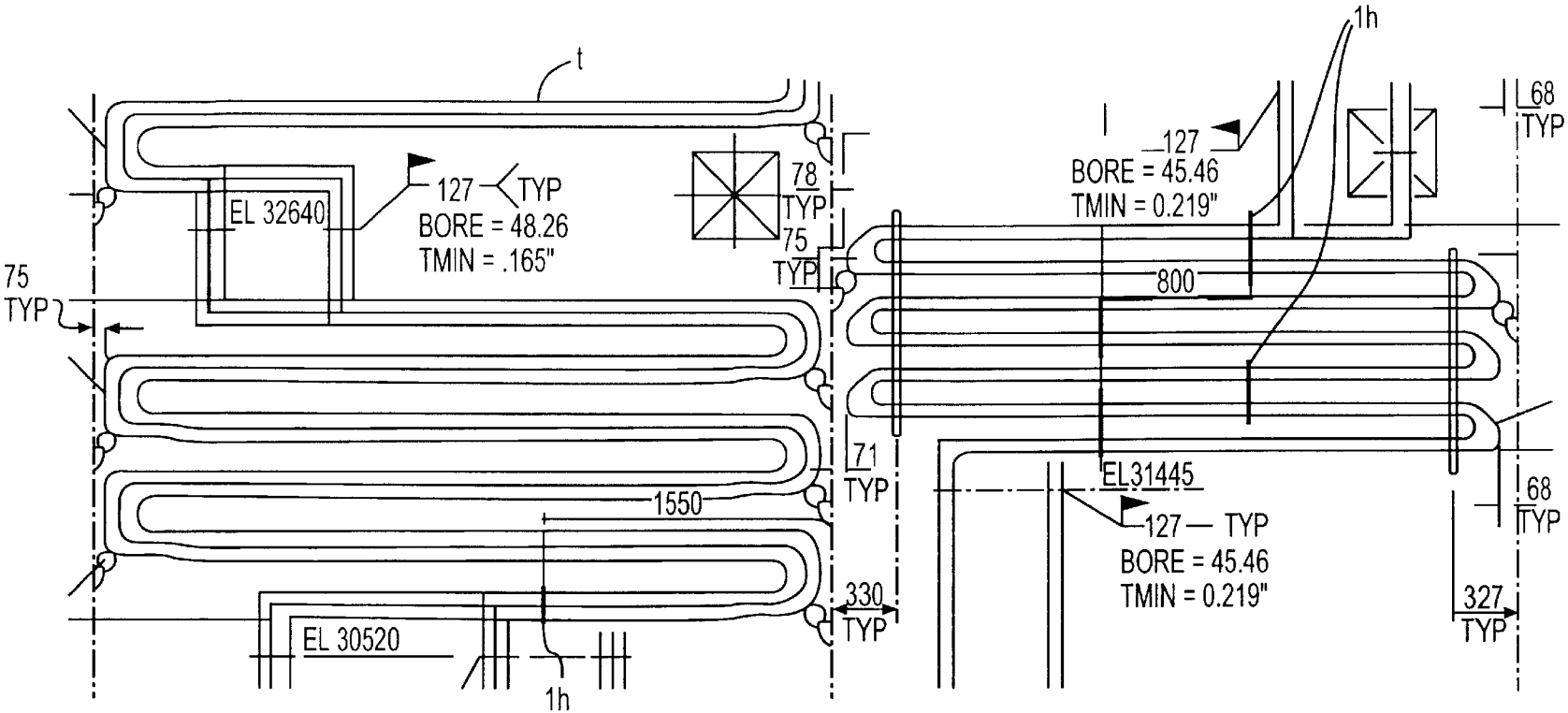
FIG. 3A is a schematic view of a two loop-in-loop tube bank and a three loop-in-loop tube bank employing tube-to-tube ties according to an embodiment of the present invention.
Figure 3B:
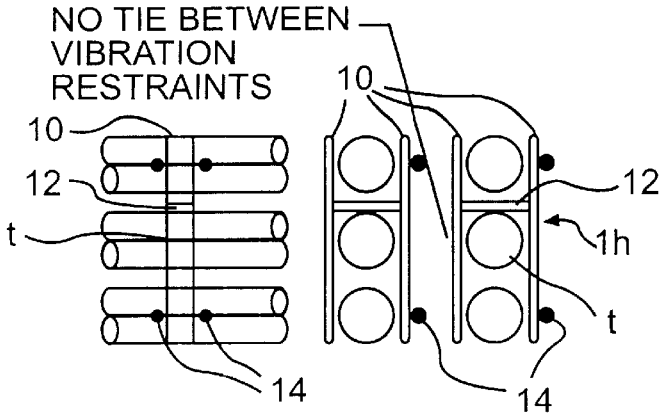
FIGS. 3B and 3C are detailed views of the tube-to-tube ties employed in FIG. 3A.
Figure 3C:
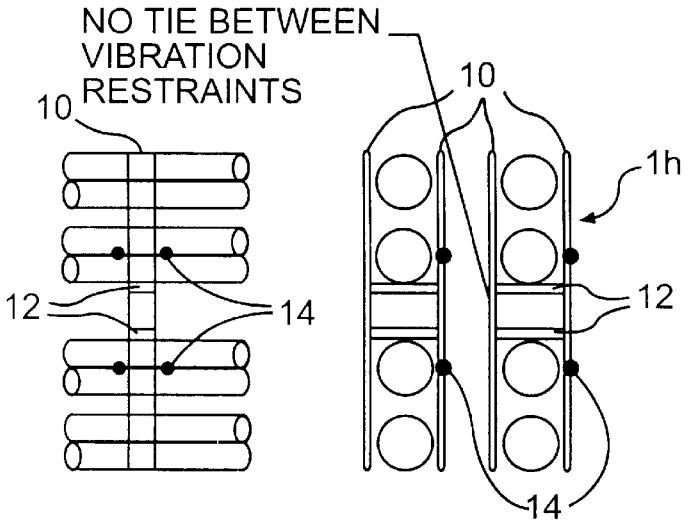
Figure 4A:
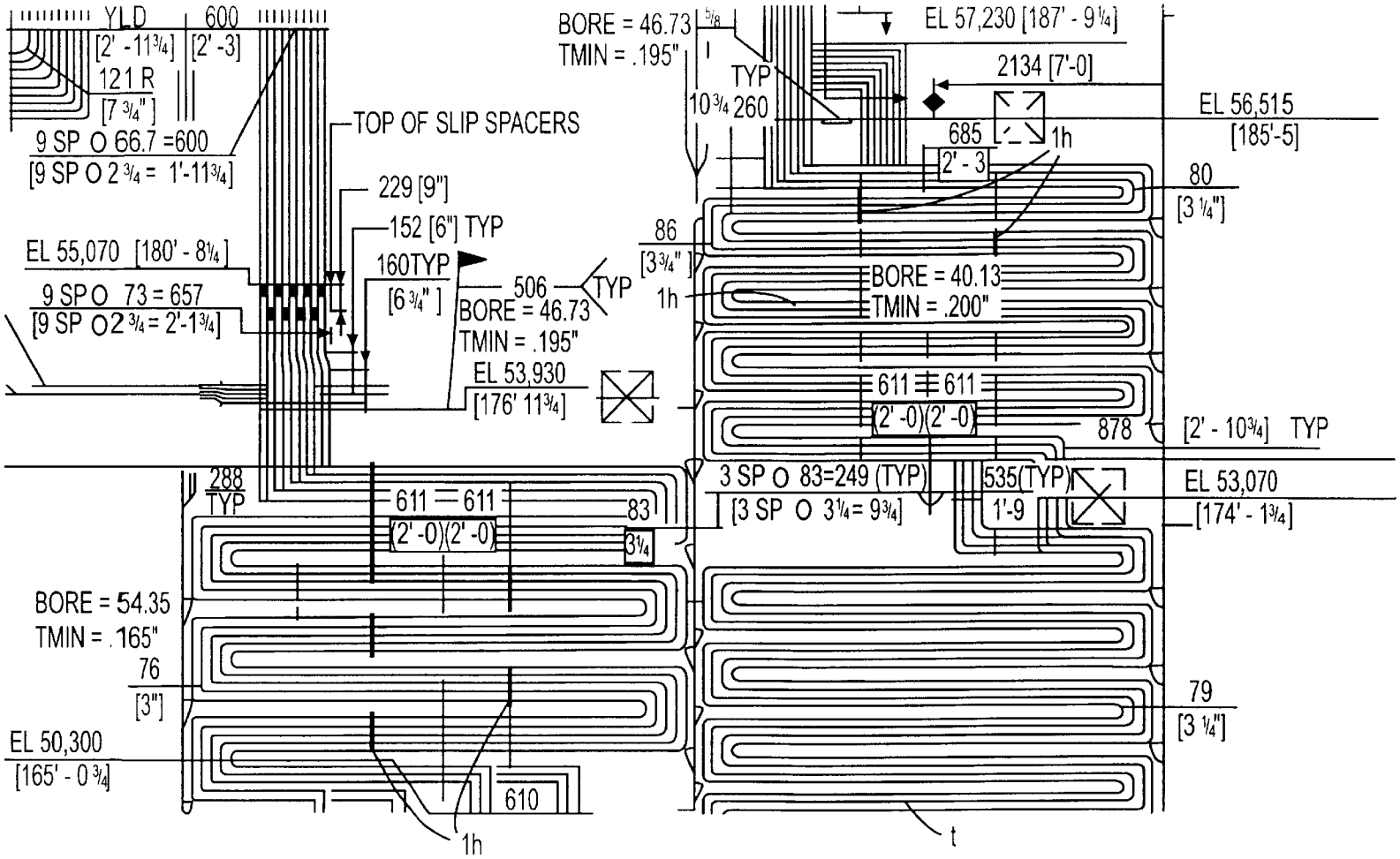
FIG. 4A is a schematic view of a four loop-in-loop tube bank and a five loop-in-loop tube bank employing tube-to-tube ties according to an embodiment of the present invention.
Figure 4B:
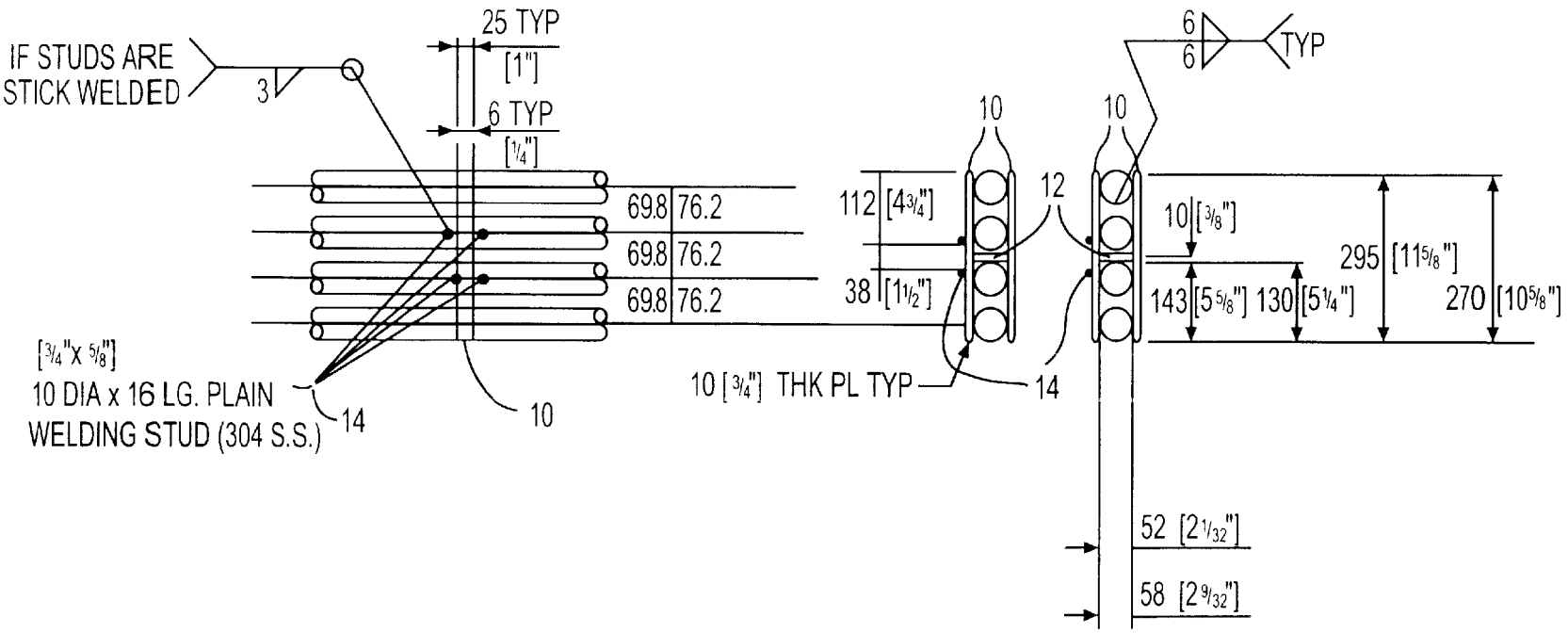
FIGS. 4B and 4C are detailed views of the tube-to-tube ties employed in FIG. 4A.
Figure 4C:
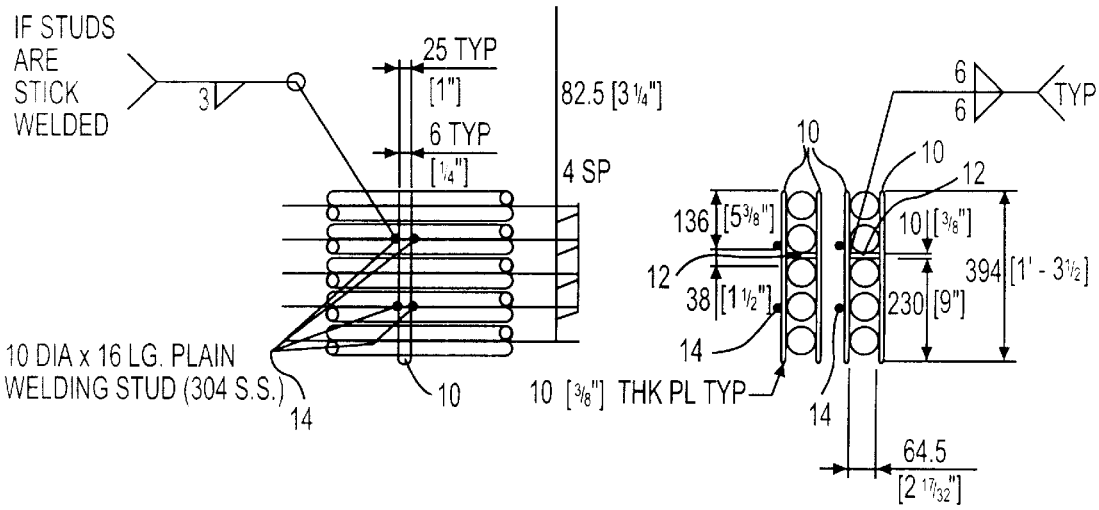

In the preferred embodiment, the tube-to-tube ties 1 are clips ("H-clips") 1*h* configured as shown in FIGS. 3A–4C. FIG. 3A illustrates two- and three-loop-in-loop tube banks, with H-clips 1*h* in place. FIG. 4A similarly illustrates four- and five-loop-in-loop tube banks. FIGS. 3B, 3C, 4B, and 4C illustrate in more detail the H-clips 1*h* shown in these various tube banks.

Each clip 1*h* has two elongated side members 10 that extend generally parallel to one another on either side of the tubes t to be tied. The side members 10 are arranged transversely to the axial direction of the tubes t, and act as lateral restraints to the tubes. The side members 10 are connected by at least one cross-bar 12, which acts to maintain the orientation and lateral spacing of the side members 10. The side members 10 and the cross-bar 12 are preferably flat, rectangular bars. Preferably, the cross-bar 12 is disposed perpendicular to the side members 10, in an "H" configuration as shown. Motion limiters 14 inhibit the clip from sliding axially along the tubes.

All parts of the clip 1*h* should be formed of a material that will withstand the elevated temperatures encountered in a tube bank, as well as the corrosive and erosive effects of the fluid flowing around the tubes t. Generally, the material will be stainless steel or a high-resistant alloy. Other materials, such as high-temperature ceramics can also be used. The clips 1*h* can be fabricated from separate pieces (welded or otherwise affixed together) or can be cast or molded as a unit.

The H-clips 1*h* primarily restrict the motion of the tubes t in the direction perpendicular to the side members. Thus, the clips 1*h* are preferably aligned perpendicular to the direction in which the vibrations cause the most concern. As will be seen, that direction is usually transverse to the flow, but will vary depending upon various factors.

In order to permit the tubes t to have the proper freedom of movement relative to the clips 1*h*, the space between the side members 10 of the clips 1*h* will be greater than the outer diameter of the tubes t, generally by between about one percent and two percent. For example, with tubes having an outer diameter of one inch, the nominal clearance between the tubes t and the side members 10 is generally no greater than 1/64 inch. With larger tubes, such as tubes having outer diameters of 1½, 2, 2½ or 2 ¾ inches, then the nominal clearance should be no greater than 1/32 inch. Depending upon the tolerances of the tubes t themselves, as well as flow thermal hydraulic conditions, the nominal clearance can be as small as about 0.01 inches, for the smaller diameter tubes, and about 0.02 for the larger. As long as the tubes t are permitted the proper rotational, axial and expansive freedom, a smaller clearance provides better vibration and wear protection.

Figure 5B:
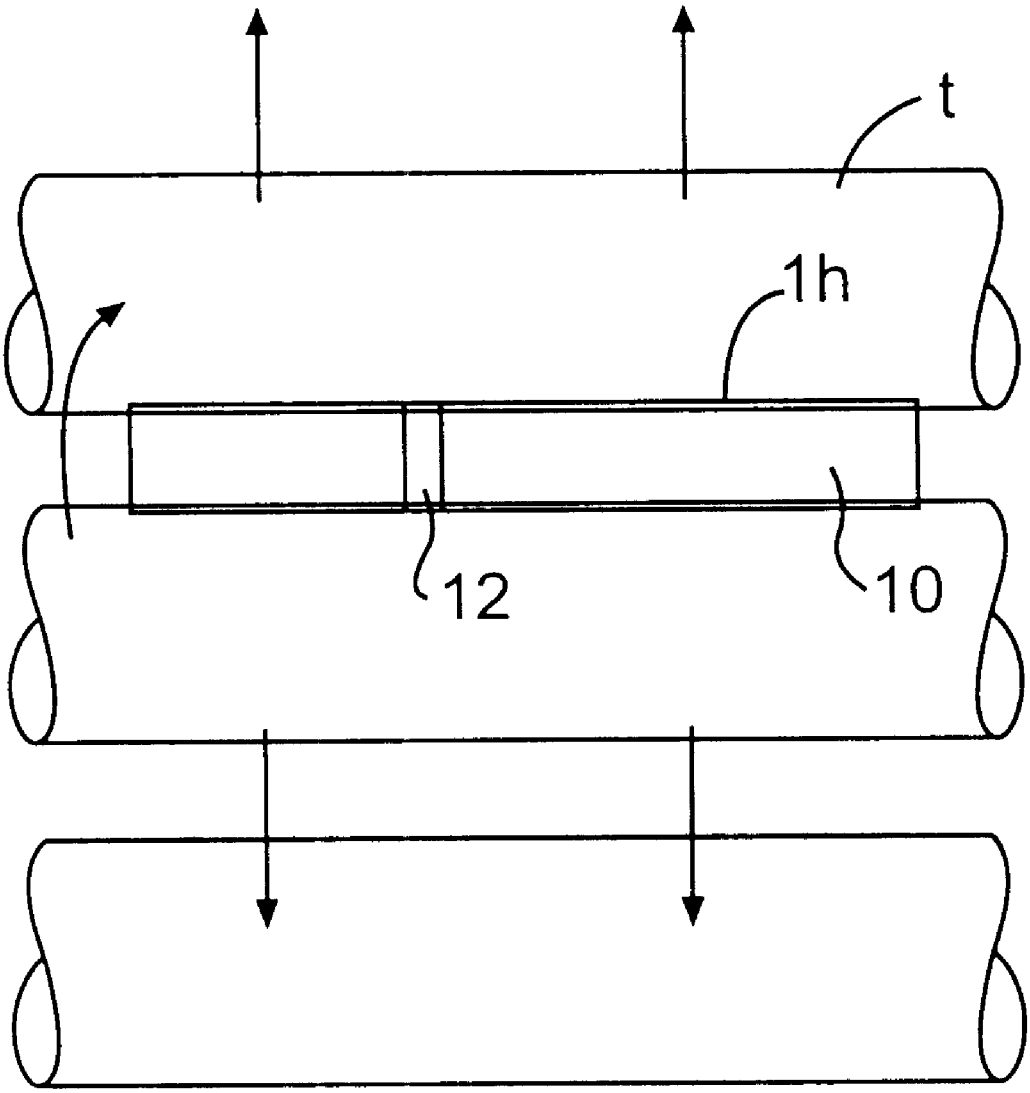
FIG. 5B is a schematic view of the tube-to-tube tie at an intermediate step of the process illustrated in FIG. 5A.

One advantage of the H-clip 1*h* design is its simplicity, and the resultant ease with which it can be formed within desired tolerances to achieve the clearances described above. Another advantage is ease of installation. As illustrated schematically in FIG. 5A, in order to install an H-clip 1*h* in the tube bank, the clip 1*h* is first aligned parallel to the tubes. A pair of the tubes t are spread slightly, and the clip 1*h* is inserted into the gap between the tubes, with the side members 10 on either side of the line tubes to be tied. Then, the clip 1*h* is simply pivoted (on an axis normal to the side members 10) into position perpendicular to the tubes with the side members 10 on either side of the tubes. Once the clip 1*h* is in position, the motion limiters 14 can be secured in place.

In the preferred embodiment, the motion limiters 14 are simply protrusions, such as studs welded to the outer surfaces of some of the tubes t, disposed on either side of the clip 1*h*. The motion limiters 14 can take any of several other forms, as long as they restrain, within limits, axial movement of the clips 1*h* relative to the tubes. For example, collars can be clamped, welded or otherwise bonded to the tubes t.

Additional embodiments of the tube-to-tube ties 1 that can function in the desired manner are shown in FIGS. 6A (a "slip spacer"), 6B (a "clamp"), and 7A–C (two-, three-, and four-tube embodiments of a "U-clip") respectively.

The slip spacer 1*s* includes complementary male and female lugs 20, 21, respectively, affixed to adjacent tubes t by welding or the like. The female lug 21 has opposing sides 22 with distal shoulders 23 that define a cavity 24 with a relatively narrow opening 25. The male lug 20 has a neck 26 and a widened distal end 27 configured to fit through the opening 25 and within of the cavity 24, respectively, of the female lug 21. The female lug 21 provides a lateral restraint to the movement of the male lug 20, and vice versa. The distal end 27 of the male lug 20 should have freedom of movement within the channel 24 of the female lug 21 within the above-described tolerances.

It is preferred that the cavity 24 be a channel open at each longitudinal end, and that the opening 25 extend the length of the channel, so as to permit free axial movement (including insertion during installation) of the male lug 20. In any case, the male and female lugs 20, 21 should be sized to permit them to move axially relative to one another. Thus, the motion limiter (in this case, the welds holding the lugs to the tubes) can in this case affix the lugs 20, 21 directly to the tubes t.

The clamp 1*c* includes complementary contoured side bars 30, which are clamped about the tubes by a stud or nut-and-bolt 32. Alternatively, the side bars 30 can be welded together. The side bars 30 each include half-pipe arches 34 that combine to form seats for the tubes t. The arches 34 should be configured to permit the tube t freedom of movement within the above-described tolerances. Thus, the outermost areas of the side bars 30, adjacent to the apices of the arches 34, act to laterally restrain the tube t in the manner of the side members 10 of the H-clip 1*h* (FIGS. 3A–4C). The span of the arches between these apices determines the lateral spacing of these apices, in the manner of the cross-bar 12 of the H-clip 1*h*. The clamp 1*c* can be restrained from axial movement by motion limiters (not shown) similar to those discussed above in connection with the H-clips.

Figure 7A:
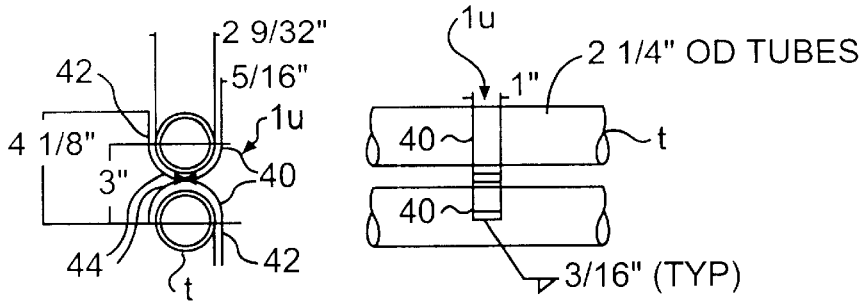
FIGS. 7A–7C are schematic illustrations of alternate embodiments of tube-to-tube ties according to the present invention.
Figure 7B:
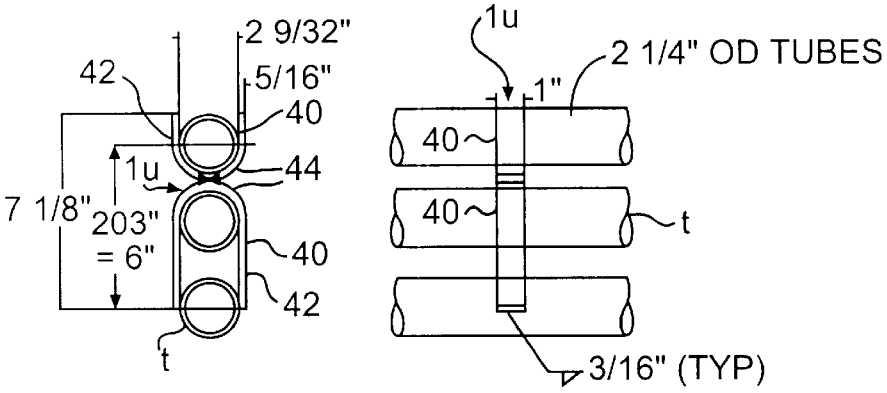
Figure 7C:
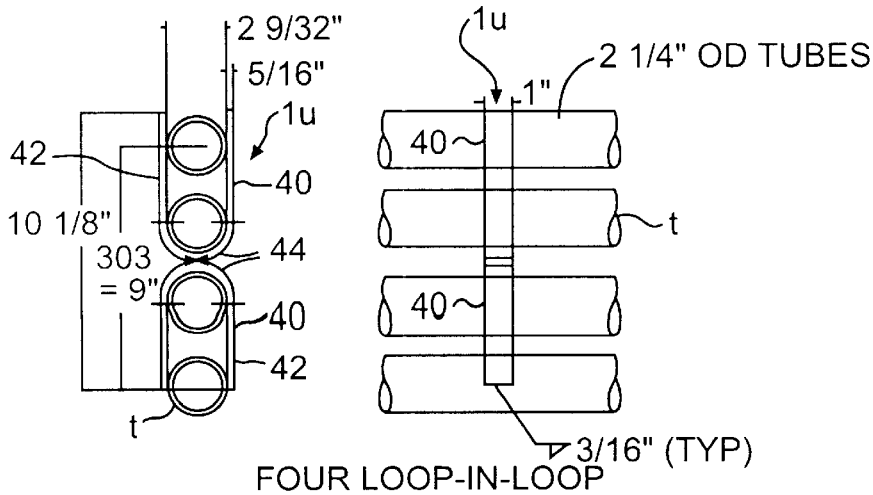

The U-clips 1*u* include a pair of U-shaped bars 40, each including parallel legs 42 connected by an arcuate base 44. In the two loop-in-loop embodiment (FIG. 7A), one of the bars 40 may only have very short legs 42 so as to encase substantially half of one tube t. The bases 44 are each shaped to fit around one of the tubes t, and the bases 44 are juxtaposed so as to abut one another at their apices, where they are joined by welding or the like. The U-shaped bars 40 are configured to permit the tube t freedom of movement within the above-described tolerances. Thus, the legs 42 of the bars 40 act to laterally restrain the tube t in the manner of the side members 10 of the H-clip 1*h* (FIGS. 3A–4C). The arcuate bases 44 determine the lateral spacing of these legs 42, in the manner of the cross-bar 12 of the H-clip 1*h*. The U-clips 1*u* can be restrained from axial movement by motion limiters (not shown) similar to those discussed above in connection with the H-clips.

As will be illustrated below, only a small number of tubes t need to be tied together to realize significant gains in vibration resistance. Often, tying two tubes together is sufficient to greatly reduce vibration. In most cases, I prefer to tie three to six tubes together to achieve the best results. Tying too many tubes together can be counterproductive. The flexibility of the bundles will be compromised, undermining the freedom of the tubes for thermal expansion. Also, a large number of tubes tied together can induce undesired vibration from non-fluidelastic effects, such as "galloping", or the like, due to the rotational characteristics of the elongated tube bundle as a whole.

Under most flow conditions, the strongest tendency is for the tubes t to vibrate in the direction transverse to the crossflow. Thus, the ties 1 (be it H-clips, slip spacers, clamps, U-clips, or the like) should generally be oriented to tie the tubes in columns in the flow direction to maximize vibratory suppression. Thus, the H-clips 1*h*, for example, are preferably aligned in the flow direction to better prevent vibration in the direction transverse to the flow. In certain conditions, such as staggered tube banks, angular crossflows, or certain fluid characteristics, it may be advisable to tie the tubes in other directions as well. The placement and orientation of the ties will, therefore, depend on these factors, as described below.

The ties 1, when employed in the manner of my invention, impact on the fluidelastic instability of tied tube groupings. This effect of the ties 1 will be discussed with respect to tube rows, in-line tube arrays, and triangular tube arrays from two points of view. First, the effect on fluidelastic coupling and lower bound stability limits will be discussed using well-known unsteady flow theory. This theory is discussed at length in Chen, S. S., "Instability Mechanism and Stability Criteria of a Group of Circular Cylinders Subjected to Cross-Flow. Part 1: Theory," ASME Journal of Vibration Acoustics, Stress and Reliability in Design, Vol. 105, pp. 51–58 (1983); Chen, S. S., "Instability Mechanism and Stability Criteria of a Group of Circular Cylinders Subjected to Cross-Flow, Part 2: Numerical Results and Discussions," ASME Journal of Vibration, Acoustics, Stress and Reliability in Design, Vol. 105, pp. 253–260 (1983); and Chen, S. S. and Chandra, S., "Fluidelastic Instabilities in Tube Bundles Exposed to Nonuniform Crossflow," Argonne National Laboratory, ANL-89/13 (1989), (collectively, "the Chen references") all of which are incorporated herein by reference. Second, the structural effects on tube frequency and damping (and, therefore, on stability) of the tube row or a tube array will be discussed.

The numerical analysis of the effect of the tied tubes, discussed briefly below, is outlined in two papers by the inventor of this invention: Eisinger, F. L. and Rao, M. M., "Effect of Tube-to-Tube Ties on Fluidelastic Instability of Tube Arrays Exposed to Crossflow", $4^{th}$ International Symposium on Fluid-Structure Interactions, Aeroelasticity, Flow-Induced Vibration and Noise, Vol. 2, AD Vol. 53–2, The American Society of Mechanical Engineers, pp. 221–228 (1997), incorporated herein by reference; and Eisinger, F. L. and Rao, M. M., "Effect of Tube-to-Tube Ties on Fluidelastic Instability of Normal Triangular Tube Arrays Exposed to Crossflow", American Society of Mechanical Engineers, PVP-Vol. 363, Flow-Induced Vibration and Transient Thermal-Hydraulics, Book No. H01144-1998, pp. 45–51, also incorporated herein by reference.

The addition of tube-to-tube ties 1 to a tube array in the manner of the present invention generally increases the fluidelastic instability thresholds. In some cases, depending upon the range of mass-damping parameter (discussed more fully below—generally reflecting a relationship between the tube size and mass density, the logarithmic decrement of damping, and the fluid mass density) in question and tie arrangement, the increase in the fluidelastic instability thresholds may be quite substantial. This effect on fluidelastic instability thresholds has been evaluated numerically for various arrangements of both tube rows and tube bundles equipped with tube-to-tube ties 1 of the present invention, with ties 1 oriented in the flow direction, transverse to flow or a combination of the two. The effect has also been studied in a triangular tube bundle equipped with tube-to-tube ties 1 oriented in the lift direction, in the diagonal direction, and in the flow direction.

In general, the method of this invention will now be demonstrated in terms of tube arrays with the following geometries: (i) a tube row having a pitch-to-diameter ratio (P/D) of 1.33; (ii) a tube bundle comprising an in-line square array with a P/D of 1.33; and (iii) a normal triangular array with a P/D of 1.35 exposed to crossflow in the 30 degree direction. The tie arrangements of this invention have been analyzed with respect to these tube array geometries because the experimentally-determined fluid damping and fluid stiffness coefficients needed for the evaluation are readily available.

For purposes of numerical analysis, and by way of comparison to the tied tubes according to this invention, a fully flexible tube row will be represented by three flexible tubes surrounded by rigid tubes, and a fully flexible tube bundle will be represented by five flexible tubes surrounded by rigid tubes. With respect to the triangular arrays, a fully flexible array will be represented by five flexible tubes surrounded by rigid tubes representing either the upstream or the downstream portions of the overall tube bank, and by seven flexible tubes surrounded by rigid tubes, representing the middle of the tube bank. The behavior, including the fluid-damping and fluid-stiffness coefficients, in each of these fully flexible configurations in various flow conditions has been rigorously studied, cataloged and published. In the discussion that follows, for both the fully flexible tube groupings and the tube groupings equipped with the ties, the structural damping used in the analysis was one quarter of one percent of critical.

FIGS. 8A–8I and 9B–9J are stability maps of reduced velocity versus mass-damping parameter for the various tube groupings discussed above. FIGS. 8A–8I relate to in-line tube arrays, while FIGS. 9B–9J relate to triangular arrays. These plots were constructed utilizing the constrained mode approach discussed in the above-noted Chen references. As can be seen, by reducing the number of degrees of freedom of the tube array, the tube-to-tube ties 1 according to the present invention affect the intertube modal pattern and thereby raise the critical velocity threshold.

Figure 8A:
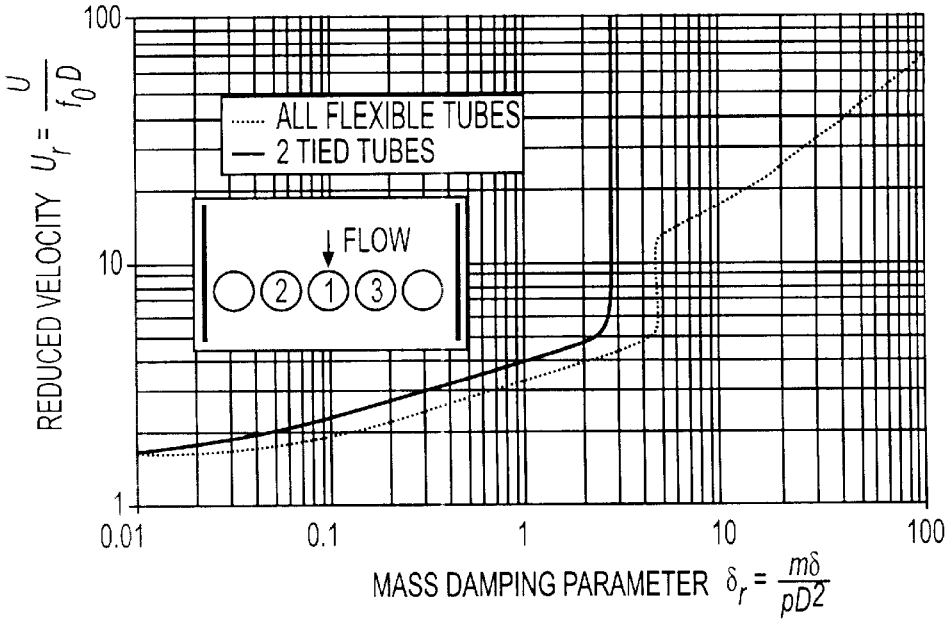
FIGS. 8A and 8B are stability maps for various tube groupings according to embodiments of the present invention in a single tube row.

FIG. 8A shows the stability map for a tube row with two tied tubes, with ties located either between tubes 1 and 2 or between tubes 1 and 3. It can be seen that while the fully flexible tube row has a defined stability limit throughout the entire range of the mass-damping parameter. The tube row with the ties is fully stable for a mass-damping parameter of about 3.8 or greater. The tied tube row also has an increased stability limit in the lower mass-damping parameter range.

Figure 8B:
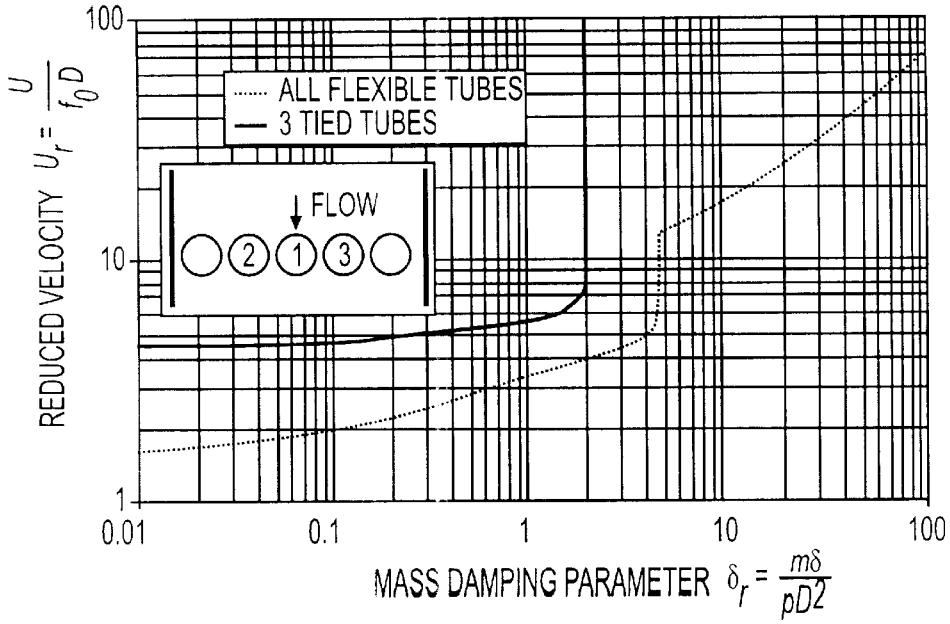

FIG. 8B shows the stability map for a tube row when three tubes are tied to each other, with ties located between tubes 1 and 2 and between tubes 1 and 3. The tube row with the ties would not go unstable for a mass-damping parameter of about 2 or greater, but could become unstable for lower values of mass-damping parameter. However, the stability limit in this range is greatly increased over the fully flexible tube row.

Thus, the tied tube rows become fully stable in the lowest (fundamental) natural frequency mode in the higher mass-damping parameter range (about 3.8 or above) and have a substantially increased fluidelastic critical velocity in the lower mass-damping parameter range.

FIG. 8C shows a stability map for a tube bundle with two tubes tied together in the flow direction. Results for two cases, either tying tubes 1 and 2 or tubes 1 and 3 are shown. It can be seen that there is improvement relative to the fully flexible array. In the case of the ties between tubes 1 and 2, there is a relatively mild increase in the fluidelastic stability threshold. However, with the ties connecting tubes 1 and 3, the increase in the threshold is substantial over most of the range of the mass-damping parameter. In the very low range of mass-damping parameter, the instability threshold results are not reported here as these appeared quite complex. From the results that are reported, it can be seen that the tube-to-tube ties inside the tube bundle (between the second and the third tube row) are more efficient in raising the critical velocity than are the ties between the first and the second row. The stability limit for a fully flexible tube row is also shown for comparison.

FIG. 8D shows the stability map for a tube bundle with three tubes tied in the flow direction. It can be seen that the effect of the ties is very strong, raising the stability limit substantially over most of the range of the mass-damping parameter. The strong effect of the ties is primarily due to the fact that the tubes in the first, second and the third tube rows, counting inward from the outside, tend to move out-of-phase relative to each other, and thus, by tying the tubes together, the fluidelastic resistance of the tubes is strongly increased.

Thus, the tube ties connecting two tubes or three tubes in the flow direction can have a substantial effect on the stability thresholds in the fundamental tube frequency structural modes. The ties are especially effective if placed between the tubes in the inner rows (starting from the second row inward), but also are effective when placed between the tubes in the first and second row. The effectiveness of these ties can be explained by a strong effect on the tendency of the tubes to vibrate in the alternating out-of-phase mode primarily in the lift direction.

FIGS. 8E and 8F show stability maps with ties oriented transverse to the flow, utilizing ties between two tubes and three tubes, respectively. The effect on fluidelastic instability is mostly in the low mass-damping parameter range. At high mass-damping parameter values, the effect is relatively small. Thus, the ties placed between the tubes in the transverse direction (i.e., perpendicular to the flow direction) are generally less effective in the high mass-damping parameter range but seem to be quite effective in the lower range. This is consistent with the intertube motions where, in the high mass-damping parameter range, the tube motion is more in-phase, and the tube ties are thus basically riding with the tubes. In the lower mass-damping parameter range, the tubes tend to move more out-of-phase relative to each other and thus, a greater effectiveness of the ties can be seen.

Figure 8I:
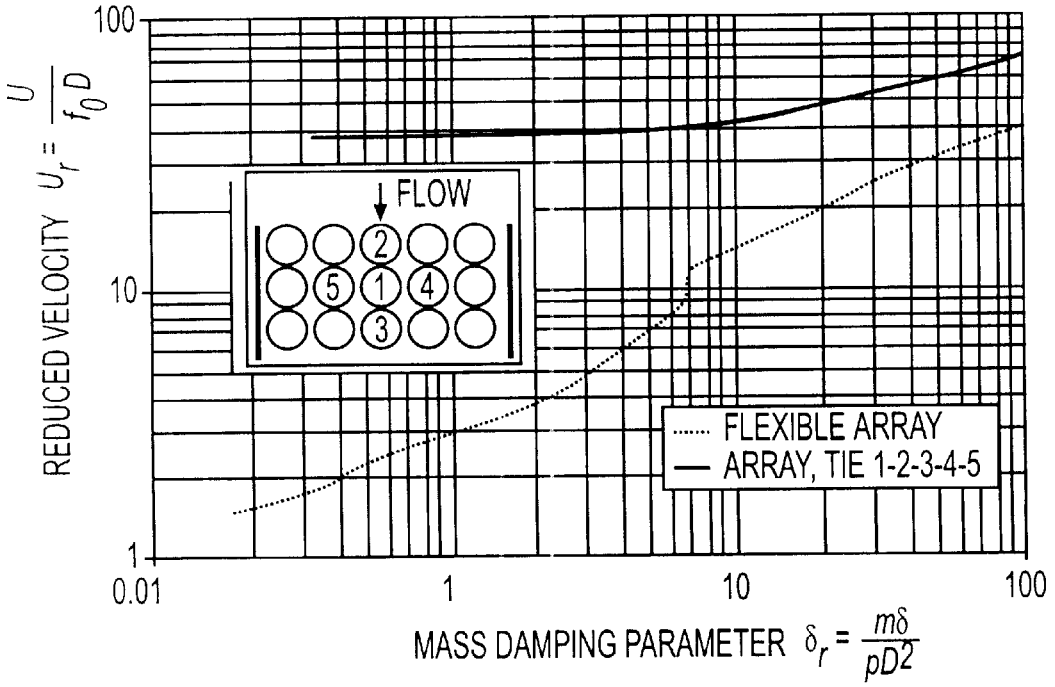

FIGS. 8G and 8H show stability diagrams with ties oriented in both the flow and transverse directions, utilizing two ties and three ties, respectively, as indicated. The fluidelastic stability thresholds are increased throughout but the increases are stronger in the lower mass-damping parameter range of about 7 or less. FIG. 8I shows a stability diagram for a tube array utilizing four tube-to-tube ties, two each oriented in the flow and transverse directions, to tie together five tubes as indicated. This stability diagram shows a strong increase in the onset of fluidelastic vibration. Thus, the use of additional ties may not necessarily be beneficial, unless all of the tubes are tied, which may not be practical in many cases.

Figure 9A:
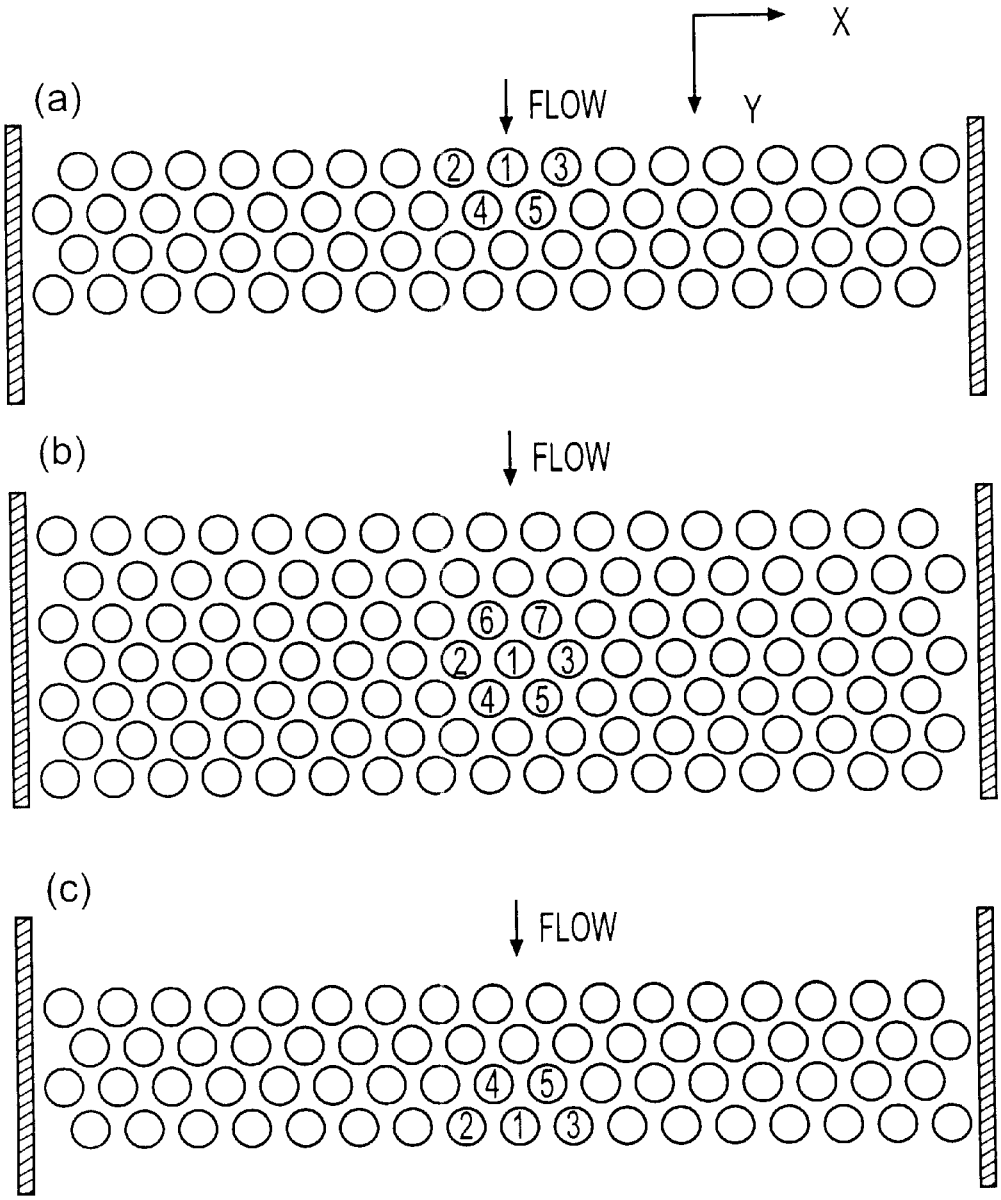
FIG. 9A is a schematic cross section of triangular tube arrays.
Figure 9B:
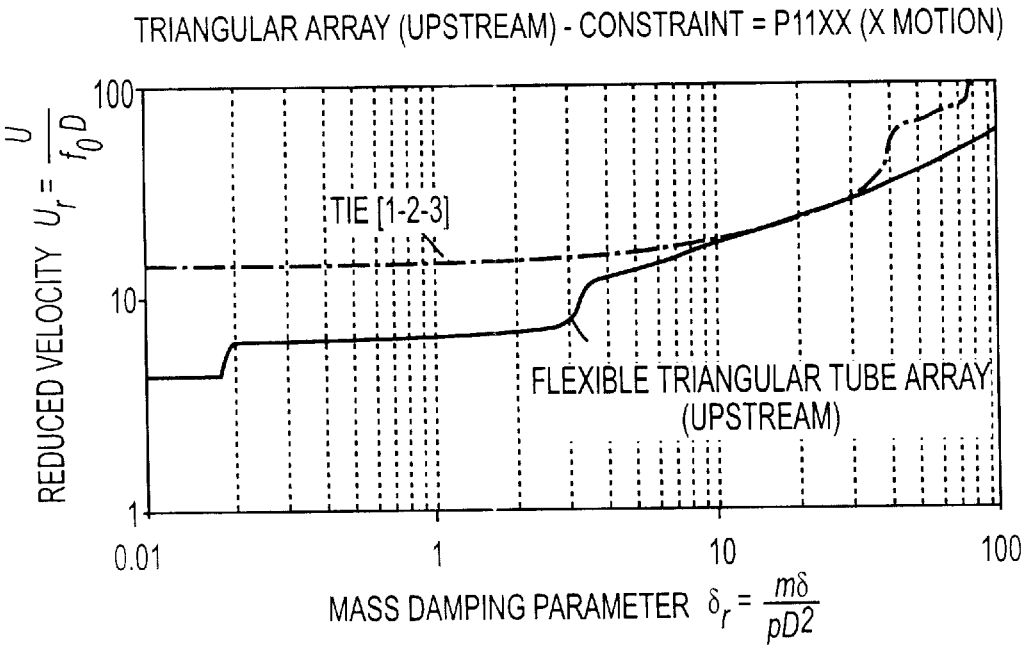
FIGS. 9B–9J are stability maps for various tube groupings according to embodiments of the present invention in the array of FIG. 9A.
Figure 9C:
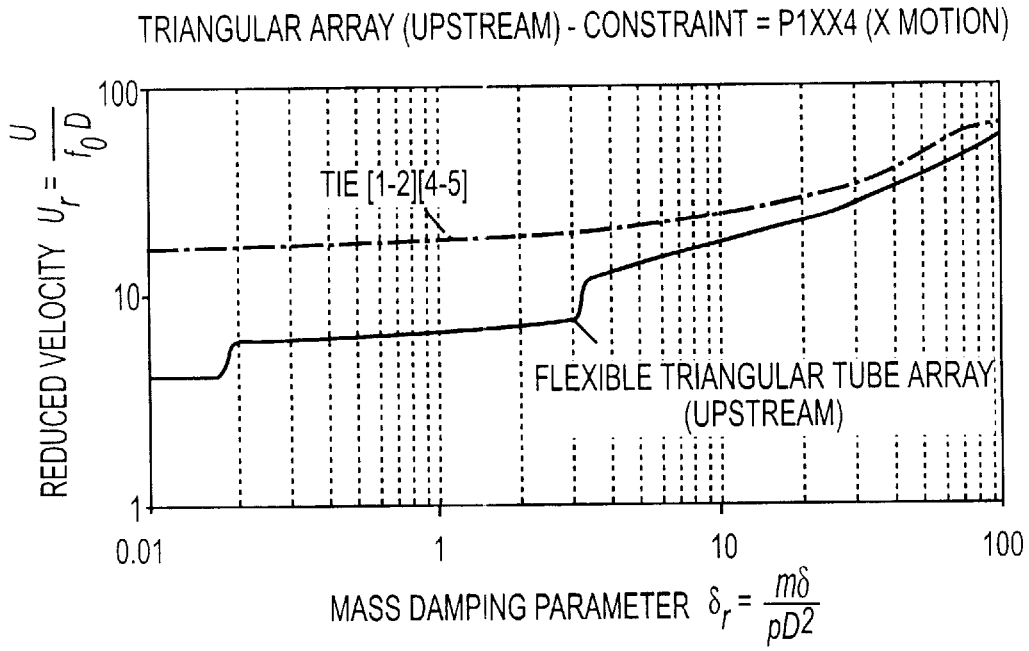

Turning to the triangular tube arrays, FIG. 10 summarizes all of the tube-to-tube tie configurations studied for the upstream, middle and the downstream portions of the tube bank. FIG. 9A shows the locations within the bank of the tubes referenced in FIG. 10 and FIGS. 9B–9J. As can be seen, in some cases, the tube bank becomes fully stable. In those in which instability is predicted even with the tube-to-tube ties in place, it occurs at higher thresholds.

Figure 9D:
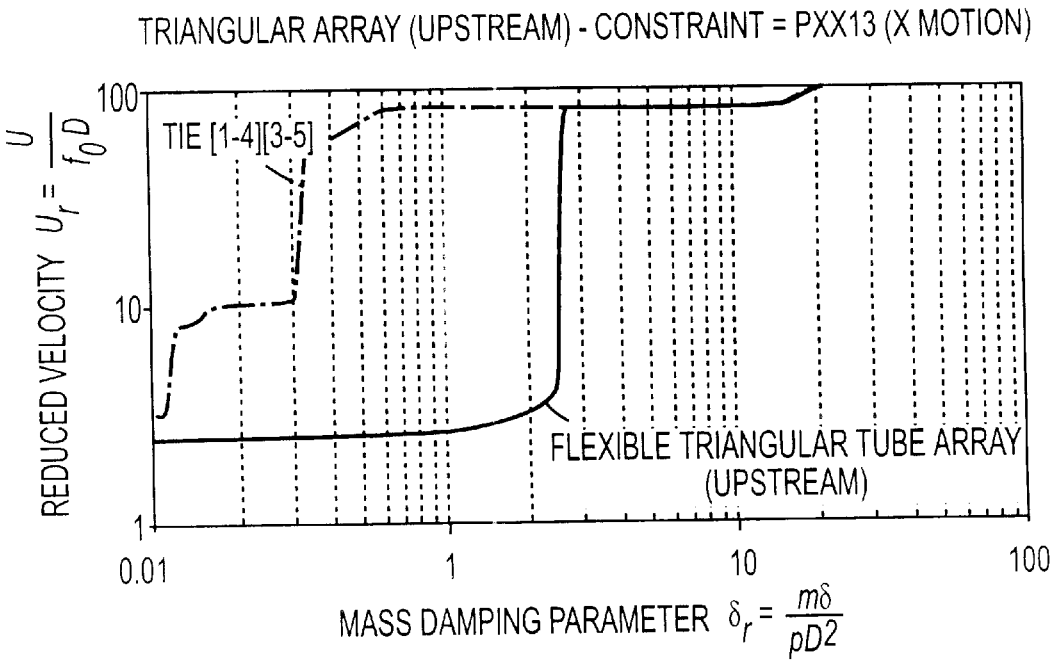
Figure 9E:
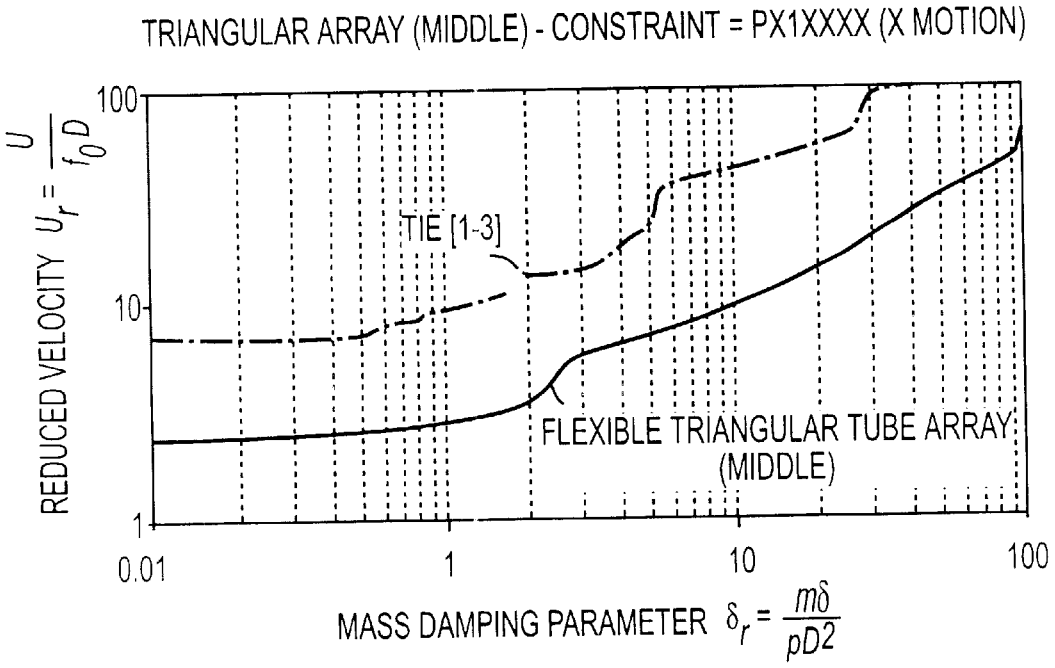
Figure 9F:
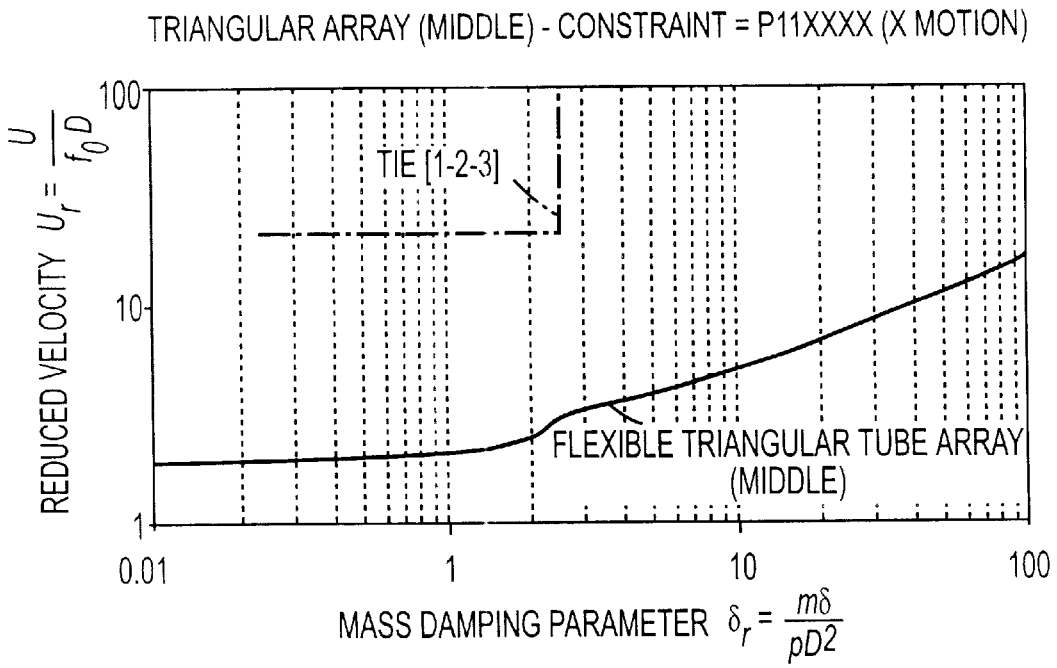
Figure 9G:
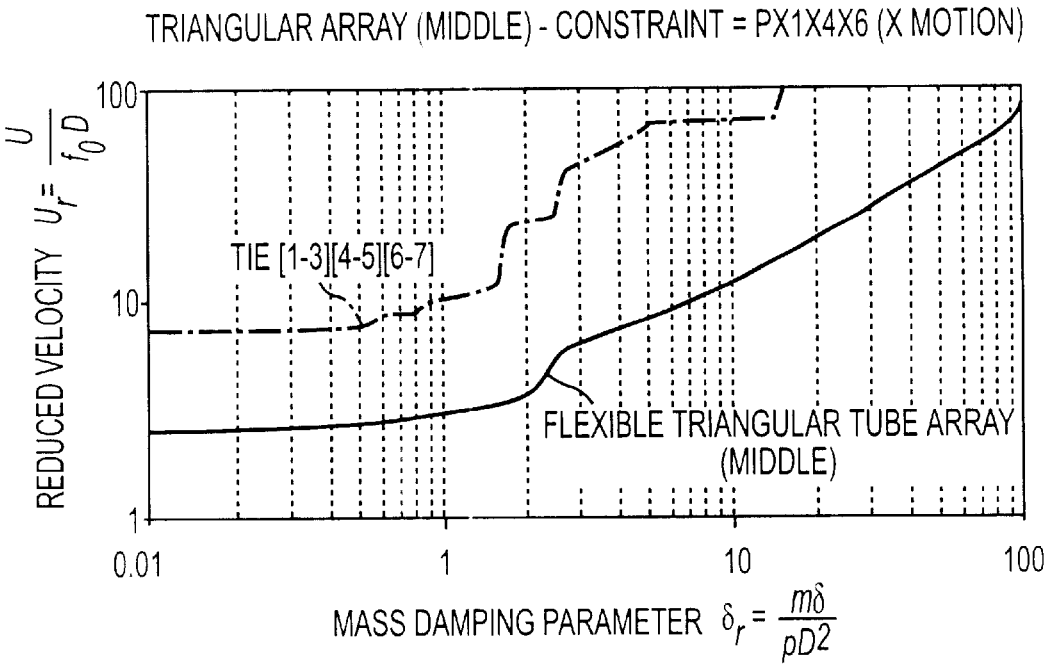
Figure 9H:
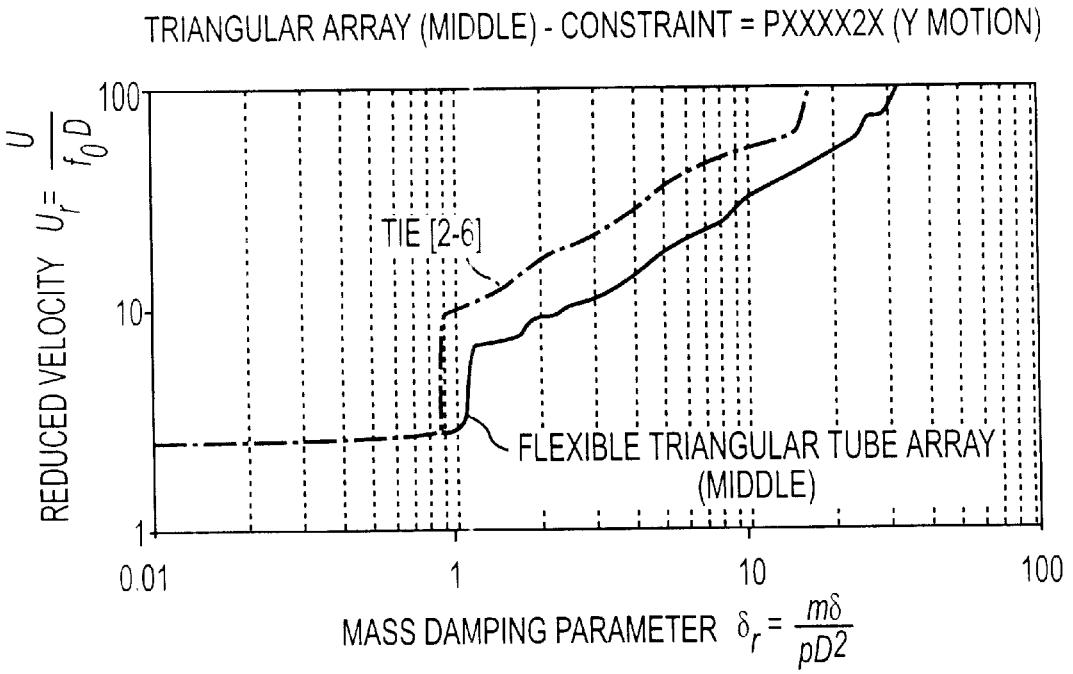
Figure 9I:
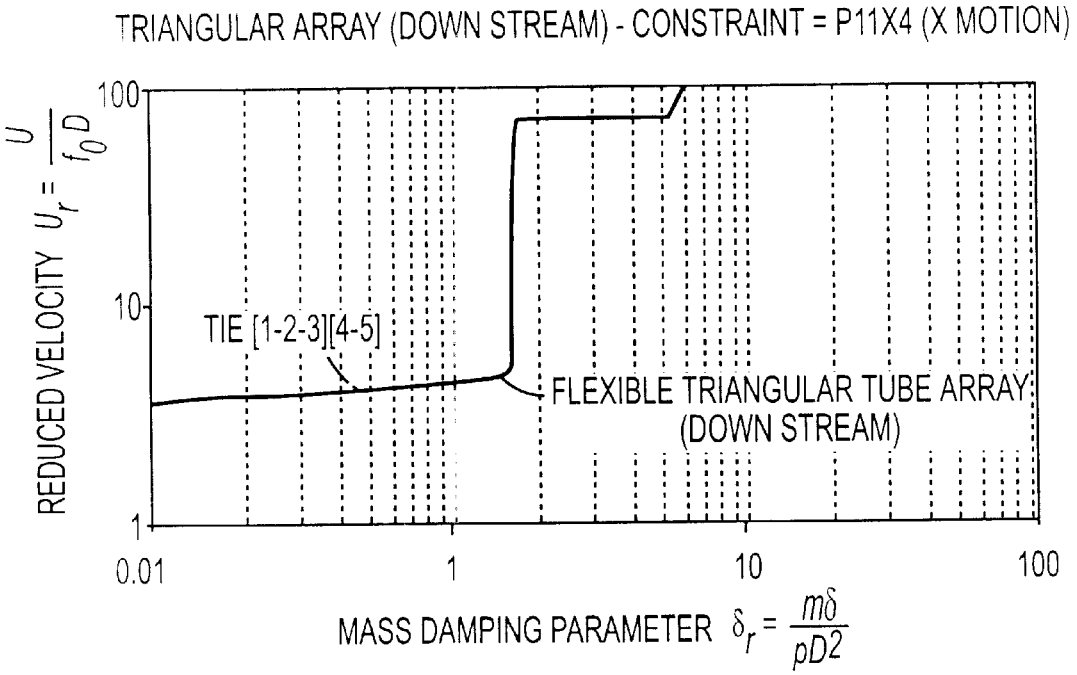
Figure 9J:
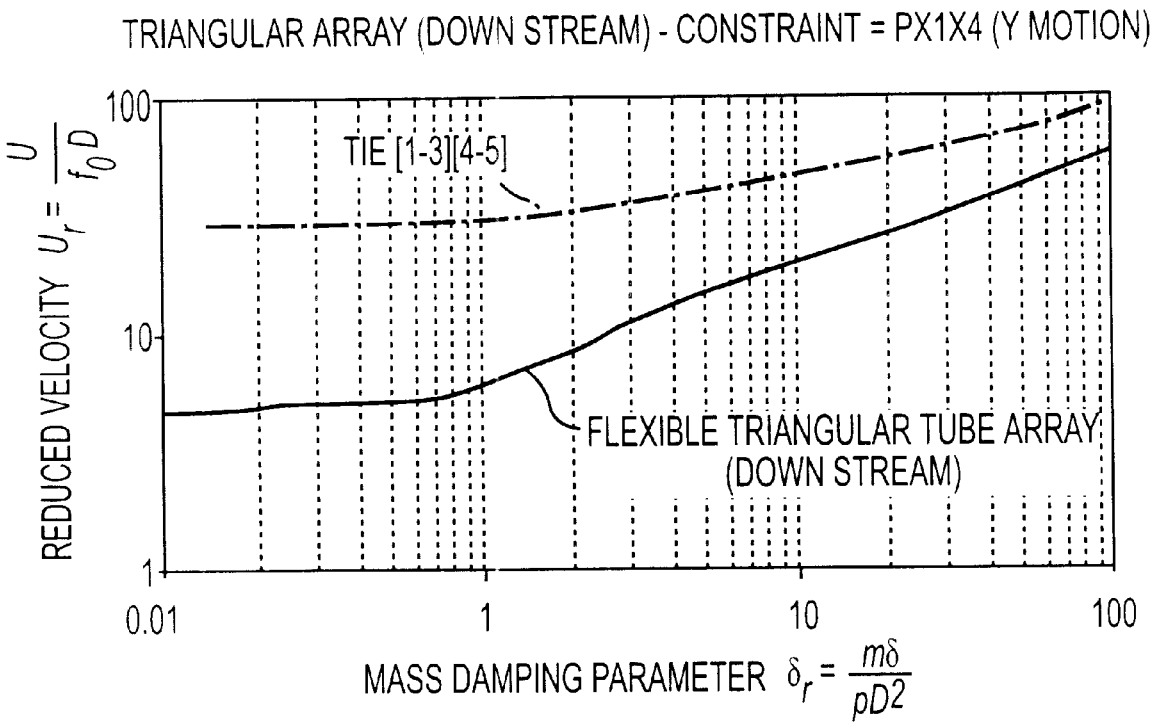
Figure 11A:
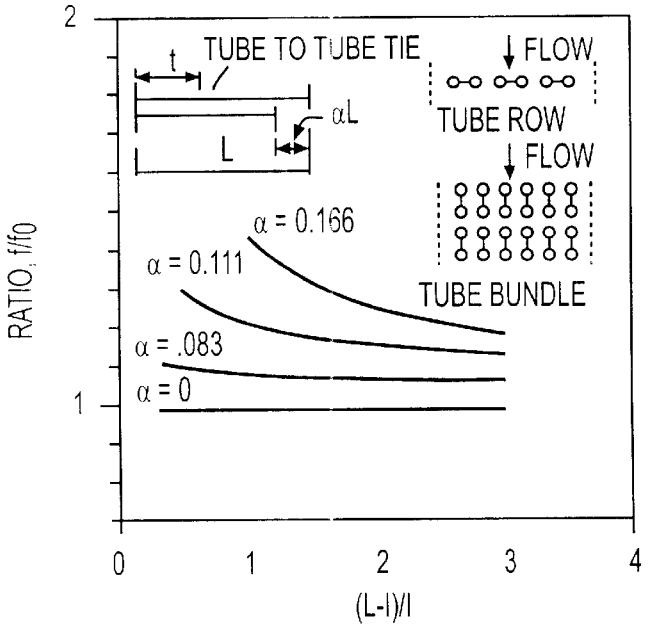
FIGS. 11A and 11B are graphical representations of the effect of location of tube-to-tube ties according to embodiments of the present invention.
Figure 11B:
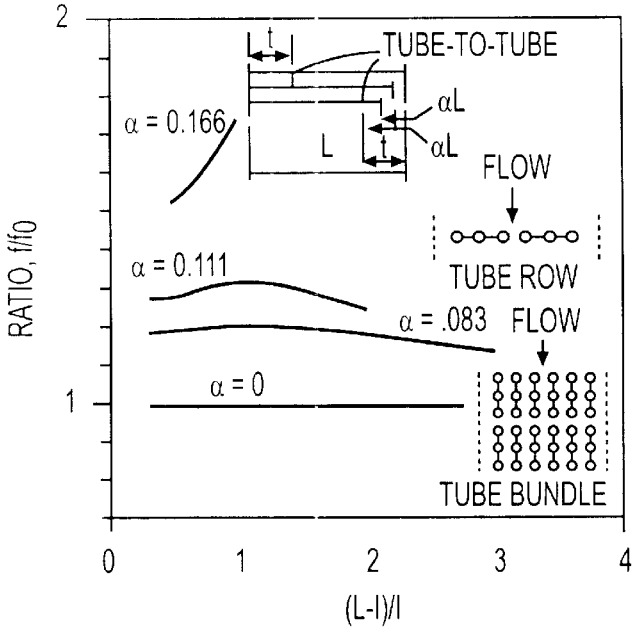

FIGS. 9B–9J are sample stability maps of velocity versus mass-damping parameter for some of the cases for which fluidelastic instability is increased by the presence of ties, in some cases quite significantly. As can be seen, the fully flexible tube bank is highly resistant to fluidelastic instability in the drag direction (y-direction) in its upstream portion and has about the same resistance in the lift direction in its downstream portion (FIGS. 9D and 9I, respectively). The middle portion of the tube bank appears to be more resistant in the drag direction (y-direction) in the high mass-damping parameter range.

FIGS. 9B, 9E, 9F and 9H show stability maps for the upstream and middle sections of the tube bank in which only two or three tubes out of the five or seven flexible tubes, respectively, are tied to each other. It can be seen that the effect of these ties can be quite significant even though only a portion of the flexible tubes is restrained. FIGS. 9C, 9D, 9G, 9I and 9J show sample stability maps for the upstream, middle and downstream portions of the tube bank where groups of two and/or three tubes are tied to each other in such a way that most or all of the flexible tubes are equipped with ties. Such an arrangement may be representative of a uniform tie arrangement between groups of two, three or more tubes throughout the tube bank. It can be seen that the uniform tie arrangement would further increase the fluidelastic instability thresholds, and in some cases or in some ranges of mass-damping parameter render the tube bank fully stable.

Thus, it is possible to select a tube-to-tube tie configuration which will beneficially affect (increase) the stability of a triangularly-arrayed tube bank in both the lift and drag directions. For example, tying of tubes 1-2-3 (see FIG. 9A) raises the fluidelastic instability in the lift direction, while in the drag direction the tube bundle would be fully stable throughout the entire bundle.

In the case of arranging ties in a triangular array in the lift direction (either upstream (1–3)(4–5), in the middle (1–3)(4–5-)(6–7), or downstream (1–2–3)(4–5)) will render the tubes fully stable in the drag direction and will increase their stability threshold in the lift direction.

Tying the tubes in a triangular array in the diagonal direction (upstream (1–5)(2–4), in the middle (1–5)(2–4)(3–7), or downstream (1–5)(2–4)), significantly increases stability, especially in the lift direction.

Briefly discussing the numerical analysis, from the foregoing stability diagrams (FIGS. 8A–8I and 9B–9J) one obtains the critical reduced velocity $$U_{r.cr}=U_{cr}/f_0D$$

for a given mass-damping parameter ($\delta_r=m\delta/\rho D^2$), which may include the effect of the ties on tube mass as well as on structural damping. Here $U_{r.cr}$=critical reduced flow velocity in gap between tubes, dimensionless $U_{cr}$=critical crossflow velocity in gap between tubes, m/s $f_0$=tube fundamental natural frequency, Hz D=tube outside diameter, m $\delta_r$=mass-damping parameter, dimensionless m=tube mass per unit length (includes tubeside fluid and virtual mass of outside fluid), kg/m $\delta$=logarithmic decrement of damping, dimensionless $\rho$=flow density, kg/m$^3$ Referring to FIGS. 10A and 10B, discussed in more detail below, the increase in tube frequency due to the location of the ties and the specific length parameter of the tied tubes is given by the ratio $$r_f=f/f_0$$

where $r_f$=frequency ratio, dimensionless f=increased tube fundamental frequency due to the presence of ties, Hz $f_0$=tube fundamental frequency without ties, Hz.

From the foregoing, we obtain the critical fluidelastic velocity as follows:

$$U_{cr}=U_{r.cr}fD.$$

Thus, the positive effect of the tube-to-tube ties 1 on fluidelastic stability is readily apparent. This effect is due to the influence on the intertube coupling and modal pattern.

The tube-to-tube ties 1 appear to have two additional effects on the structural properties of the tube banks. First, there may be an effect on the structural natural frequency of the tubes tied to each other. Second, because the tube-to-tube ties have a sliding-type connection to permit free thermal expansion, they typically provide some additional structural damping.

FIG. 10A shows a plot of the effect of a tube-to-tube tie between two tubes on the tube natural frequency of the combined two-tube system. The effect of two parameters is shown: (1) the effect of the parameter $\alpha$, which defines the difference between the lengths of the two tubes, and (2) the effect of the location of the tie, given by the parameter (L–l)/l, where L is the tube length, and l is the position of the tie. The results are equally valid for the in-plane and also for the out-of-plane vibratory motion of the tied tube system. The increase in the tube natural frequency f over that of $f_0$ due to the effect of $\alpha$ and the position of the tie can be significant for cases of $\alpha\neq0$. For cases with $\alpha=0$ (when the tied tubes are of the same length), there is no effect on the tube fundamental frequency regardless of the tie location. For cases with $\alpha\neq0$, those representative of many tube bundles, including steam generator tube banks, the increase in the fundamental tube frequencies can be optimized by a proper location of the tie.

FIG. 10B similarly illustrates the effect of using two ties to tie three tubes to each other. Again, these results are valid for the in-plane and also the out-of-plane vibratory motions for the configurations shown. As before, one can optimize the position of the tube-to-tube ties in order to maximize their effect on the tube fundamental mode natural frequency.

It should be noted that these gains in natural frequency do not only occur when tying together tubes of different length. Similar gains in natural frequency are realized when tying together tubes of different stiffness.

As mentioned above, the ties can also provide some additional structural damping to the tubes, increasing the mass-damping parameter and thus, further increasing the fluidelastic instability threshold.

Therefore, the effect of the tube-to-tube ties on fluidelastic instability may be threefold:

(1) coupling effect, shown in the stability diagrams;

(2) structural effect increasing the tubes' fundamental mode natural frequency; and (3) effect on tube mass and structural damping of the tube bank, which can be incorporated into the mass damping parameter.

It is important to note that the foregoing discussion applies to the effect of the tube-to-tube ties 1 on the fluidelastic critical velocity thresholds at the fundamental (first mode) natural frequencies of the tubes t. These thresholds are increased in all of the studied tie arrangements, in some cases substantially. Although the presence of the ties 1 may affect the tube frequency in the fundamental mode and thus further raise the critical velocity threshold, this effect while relatively mild by itself, may, in combination with the fluid-coupling effect become quite strong in some cases. This discussion has not addressed the effect of the ties 1 on the tube higher natural frequencies. It is clear that the ties 1 will promote the development of higher tube structural modes at which the fluidelastic limits for the fully flexible tube array would apply. Although these limits are lower than those for the fundamental modes, the critical velocities will be much greater at the higher frequency modes.

In the tube banks in which the tubes t are aligned in rows relative to the crossflow, the tube-to-tube ties 1 are shown above to have a strong effect on the increase of the fluidelastic instability of the tube rows. The use of more ties 1 may not be necessarily beneficial, unless all of the tubes t are tied. Of course, this may not be a practical solution in many cases.

The structural effect of the ties 1 may be important in those cases in which an advantage can be taken of tying tubes t of different lengths or different frequencies. In such cases, the structural tube fundamental frequency of the combined tube system is raised, which in turn increases the fluidelastic critical velocity of the tube array.

With respect to the triangular array, in all the cases evaluated with the tube-to-tube ties 1 in place, the fluidelastic instability thresholds are raised. The results vary from marginal increases to substantial increases to, in some cases, full stability. The tube-to-tube ties 1 appear to be more effective when tying the tubes t in the lift direction rather than in the diagonal or drag directions. The effect of ties 1 appears to be greater on the instability of the tube bundle in the drag direction (y-direction).

In all cases, as indicated above, the increases in the stability thresholds are all achieved by affecting the intertube modal pattern without accounting for the changes in tube frequency or damping by the presence of the ties 1.

Similar results may be expected for different tube array geometries. However, in order to quantify the results, such geometries may have to be analyzed.

Therefore, the fluidelastic instability thresholds of tube arrays exposed to fluid crossflow can be raised by utilizing the tube-to-tube ties of the present invention. The effect of the ties is two-fold: (1) they affect the intertube modal vibration pattern at the fundamental natural frequency of the tubes, thereby increasing the stability thresholds and (2) the ties may also raise the natural frequency of the tubes in the fundamental mode and thus further increase the fluidelastic critical velocity limit.

While the present invention has been described with respect to what is at present considered to be the preferred embodiments, the invention is not limited to the disclosed embodiments. To the contrary, the invention is intended to cover various modifications and equivalent arrangements, some of which are discussed above, included within the spirit and scope of the appended claims. Therefore, the scope of the following claims is intended to be accorded the broadest reasonable interpretation so as to encompass all such modifications and equivalent structures and functions.

I claim:

1. A method of reducing vibration in a bank of tubes due to fluid crossflow, the tubes having substantially parallel longitudinal axes, the method comprising the steps of:

selecting a plurality of tubes of substantially equal nominal outer diameter from the bank of tubes; and interconnecting the selected tubes so as to restrict adjacent ones of the selected tubes to a range of motion relative to one another in at least one direction, transverse to the longitudinal axes of the tubes, of approximately two percent or less of the nominal outer diameter of the selected tubes, while permitting some relative motion between the adjacent tubes in the at least one direction and permitting each of the selected tubes to rotate on its longitudinal axis and expand and contract in a region adjacent to the interconnection.

2. The method according to claim 1, wherein the plurality of selected tubes all intersect a common imaginary line.

3. The method according to claim 2, wherein the imaginary line is approximately parallel to the fluid crossflow.

4. The method according to claim 2, wherein the at least one transverse direction is substantially perpendicular to the imaginary line.

5. The method according to claim 1, wherein the plurality of selected tubes is between two and six tubes.

6. The method according to claim 1, wherein the interconnecting step utilizes a tube-to-tube tie that does not connect to an external support.

7. The method according to claim 1, wherein the range of motion of the adjacent tubes relative to one another in the at least one transverse direction is between approximately one and approximately two percent of the nominal outer diameter of the selected tubes.

8. The method according to claim 1, wherein the tubes are interconnected approximately mid-span between adjacent external supports.

9. An apparatus for reducing vibration in a bank of tubes due to fluid crossflow, the tubes having substantially parallel longitudinal axes, the apparatus comprising:

a tube-to-tube tie interconnecting a plurality of tubes of substantially equal nominal outer diameter from the bank of tubes, the tie comprising complementary lateral restraints disposed on opposite lateral sides of the plurality of tubes and spaced apart by a lateral distance that is greater than, but not more than approximately two percent greater than, the nominal outer diameter of each of the plurality of tubes, wherein the tie permits each of the plurality of tubes a degree of freedom to rotate on its longitudinal axis and expand and contract in a region adjacent to the tie; and a motion limiter affixed to at least two of the plurality of tubes so as to limit longitudinal motion of the tie relative to the plurality of tubes.

10. The apparatus according to claim 9, wherein the lateral distance is between approximately one and approximately two percent greater than the nominal outer diameter.

11. The apparatus according to claim 9, further comprising a lateral spacer disposed between an adjacent pair of the plurality of tubes and interconnecting the lateral restraints so as to maintain the lateral distance therebetween.

12. An apparatus for reducing vibration in a bank of tubes due to fluid crossflow, the tubes having substantially parallel longitudinal axes, the apparatus comprising:

a tube-to-tube tie interconnecting a linearly aligned plurality of the tubes each having a substantially equal nominal outer diameter, the tie comprising opposing restraints, disposed on opposite lateral sides of the plurality of tubes, and a spacer disposed between an adjacent pair of the plurality of tubes and extending laterally between the restraints, the restraints being substantially parallel and spaced apart by a lateral distance that is greater than, but not more than approximately two percent greater than the nominal outer diameter of each of the plurality of tubes; and a motion limiter affixed to at least two of the plurality of tubes so as to limit longitudinal motion of the tie relative to the plurality of tubes.

13. The apparatus according to claim 12, wherein the restraints comprise elongated, substantially rectangular side members, and the spacer comprises an elongated, substantially rectangular cross-bar.

14. The apparatus according to claim 13, wherein the cross-bar is substantially perpendicular to the side members.

15. The apparatus according to claim 13, wherein the lateral distance between the side members is not less than approximately one percent greater than the outer diameter of the plurality of tubes.

16. A method of reducing vibration in a bank of tubes due to fluid crossflow, the tubes having substantially parallel longitudinal axes and each having a nominal outer diameter, the method comprising the steps of:

selecting a plurality of tubes from the bank of tubes; and interconnecting the selected tubes so as to restrict adjacent ones of the selected tubes to a limited range of motion relative to one another in a direction transverse to both the fluid crossflow and the longitudinal axes of the tubes, the relative range of motion for a particular tube being greater than zero but not greater than approximately two percent of the nominal outer diameter of the particular tube, without substantially restricting motion of the adjacent tubes in a direction parallel to the fluid crossflow and while permitting each of the selected tubes to rotate on its longitudinal axis and expand and contract in a region adjacent to the interconnection.

17. The method according to claim 16, wherein the plurality of selected tubes all intersect a common imaginary line.

18. The method according to claim 17, wherein the imaginary line is approximately parallel to the fluid crossflow.

19. The method according to claim 16, wherein the interconnecting step utilizes a tube-to-tube tie that does not connect to an external support.

20. The method according to claim 16, wherein each of the selected tubes has a substantially equal outer diameter, and the range of motion of the adjacent tubes relative to one another in the transverse direction is not greater than approximately two percent of the nominal outer diameter of the selected tubes.

21. The method according to claim 16, wherein the tubes are interconnected approximately mid-span between adjacent external supports.

22. An apparatus for reducing vibration in a bank of tubes due to fluid crossflow, the tubes having substantially parallel longitudinal axes and each having a nominal outer diameter, the apparatus comprising:

a tube-to-tube tie interconnecting a plurality of the tubes, the tie comprising complementary lateral restraints disposed on opposite lateral sides of the plurality of tubes, the restraints being oriented so as to restrict adjacent ones of the plurality of tubes to a limited range of motion relative to one another in a direction transverse to both the fluid crossflow and the longitudinal axes of the tubes, the relative range of motion for a particular tube being greater than zero but not greater than approximately two percent of the nominal outer diameter of the particular tube, without substantially restricting motion of the adjacent tubes in a direction parallel to the fluid crossflow, wherein the tie permits each of the plurality of tubes a degree of freedom to rotate on its longitudinal axis and expand and contract in a region adjacent to the tie; and a motion limiter affixed to at least two of the plurality of tubes so as to limit longitudinal motion of the tie relative to the plurality of tubes.

23. The apparatus according to claim 22, wherein the plurality of tubes is aligned in a direction transverse to the longitudinal axes of the tubes, each of the plurality of tubes has a substantially equal nominal outer diameter, and the lateral restraints are parallel and spaced apart by a lateral distance that is greater than the nominal outer diameter of each of the plurality of tubes and not more than approximately two percent grater than the nominal outer diameter of each of the plurality of tubes.

24. The apparatus according to claim 22, further comprising a lateral spacer disposed between not more than one adjacent pair of the plurality of tubes and interconnecting the lateral restraints so as to maintain the lateral distance therebetween.

25. An apparatus for reducing vibration in a bank of tubes due to fluid crossflow, the tubes having substantially parallel longitudinal axes and each having a nominal outer diameter, the apparatus comprising:

a tube-to-tube tie interconnecting a plurality of the tubes, the tie comprising complementary lateral restraints that are disposed on opposite lateral sides of the plurality of tubes and which restrict independent vibratory motion of the plurality of tubes relative to one another in a direction transverse to both the fluid crossflow and the longitudinal axes of the tubes, wherein the restraints are spaced by a distance which permits each of the plurality of tubes to rotate on its longitudinal axis and to expand and contract in a region adjacent to the tie, and the lateral restraints are parallel and spaced apart by a lateral distance that is greater than, but not more than approximately two percent greater than, the nominal outer diameter of each of the plurality of tubes; and a motion limiter affixed to at least two of the plurality of tubes so as to limit longitudinal motion of the tie relative to the plurality of tubes.

26. The apparatus according to claim 25, wherein the plurality of tubes is aligned in a direction transverse to the longitudinal axes of the tubes, and each of the plurality of tubes has a substantially equal nominal outer diameter.

27. The apparatus according to claim 25, further comprising a lateral spacer disposed between not more than one adjacent pair of the plurality of tubes and interconnecting the lateral restraints so as to maintain the lateral distance therebetween.

* * * * *